US007011466B2

(12) United States Patent
Iida et al.

(10) Patent No.: US 7,011,466 B2
(45) Date of Patent: Mar. 14, 2006

(54) WRITING IMPLEMENT

(75) Inventors: Hisashi Iida, Yokohama (JP); Shigeru Okumura, Yokohama (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 165 days.

(21) Appl. No.: 10/221,773

(22) PCT Filed: Mar. 22, 2001

(86) PCT No.: PCT/JP01/02293

§ 371 (c)(1),
(2), (4) Date: Sep. 17, 2002

(87) PCT Pub. No.: WO01/70515

PCT Pub. Date: Sep. 27, 2001

(65) Prior Publication Data

US 2003/0081981 A1 May 1, 2003

(30) Foreign Application Priority Data

| | | |
|---|---|---|
| Mar. 22, 2000 | (JP) | 2000/080214 |
| Dec. 1, 2000 | (JP) | 2000/366494 |
| Dec. 1, 2000 | (JP) | 2000/366495 |

(51) Int. Cl.
*B43K 5/02* (2006.01)

(52) U.S. Cl. ..... 401/40; 401/41; 401/198; 401/199

(58) Field of Classification Search ..... 401/40–42, 401/196, 198, 201, 205, 223, 224, 227, 232, 401/230, 238, 241, 199
See application file for complete search history.

(56) References Cited

U.S. PATENT DOCUMENTS

| | | | | |
|---|---|---|---|---|
| 1,978,676 A | | 10/1934 | Kingman | 120/42 |
| 1,998,930 A | | 4/1935 | Kingman | 120/42 |
| 2,131,016 A | * | 9/1938 | Fiore | 401/40 |
| 2,269,232 A | * | 1/1942 | Schreiner | 401/41 |
| 3,993,409 A | | 11/1976 | Hart | 401/199 |
| 5,433,545 A | | 7/1995 | Keil | 401/40 |
| 6,398,442 B1 | * | 6/2002 | Furukawa | 401/198 |
| 6,602,012 B1 | * | 8/2003 | Furukawa et al. | 401/224 |

FOREIGN PATENT DOCUMENTS

| | | |
|---|---|---|
| JP | 14-14173 Y1 | 9/1939 |
| JP | 15-7603 Y1 | 6/1940 |
| JP | 37-6219 B1 | 6/1962 |

* cited by examiner

*Primary Examiner*—Tuan Nguyen
(74) *Attorney, Agent, or Firm*—Kubovcik & Kubovcik

(57) ABSTRACT

Liquid-for-ink (50) and a main part of colorant (60) for coloring the liquid-for-ink (50) are separately stored within a writing implement. The writing implement is so fabricated that the colorant (60) is added to the liquid-for-ink (50) while the liquid-for-ink (50) is introduced to a writing tip (70).

14 Claims, 12 Drawing Sheets

WRITING IMPLEMENT

TECHNICAL FIELD

The present invention relates to a writing implement, and more particularly, to a writing implement utilizing ink, wherein liquid-for-ink and colorant included in the ink are stored separately, and wherein the colorant is added to the liquid-for-ink while the liquid-for-ink is introduced to a writing tip, thereby the writing implement being allowed to writing down with the ink which develops predetermined color at the writing tip.

BACKGROUND ART

Conventionally, various types of writing implements utilizing ink have been provided.

Such writing implements can be broadly classified into two groups with respect to the ink utilized.

Included in one group is a writing implement, such as a conventionally-provided writing brush, which does not contain ink in it, and which can write with ink dipped to its writing tip.

The examples of such kind of writing implements are, specifically, a writing brush, a ruling pen, a dip pen, and a drawing pen.

Included in the other group is a writing implement which contains ink in it, and which can write with the ink introduced to its writing tip.

Here, the examples of such kind of writing implements are, specifically, a fountain pen, a ballpoint pen, a felt pen, a fiber pen (a marking pen), or a needle pen.

The ink utilized in the latter type of writing implement contains dye or pigment previously dissolved or dispersed in a vehicle (a solvent or a medium) substantially uniformly, and the ink is so prepared that the color of the ink when contained in the writing implement may show approximately the same as that when transferred to a written surface.

By the way, the conventional writing implements as described above are convenient because the color of the ink transferred to a written surface can be determined by checking the color of the ink contained in the writing implement.

It has been, however, recently desired to provide a new writing implement whose appearance is definitely different from that of the conventional writing implement.

Thus, the purpose of the present invention is to provide a writing implement wherein the color of the liquid-for-ink is made to be, for example, colorlessly-transparent, different from that of colorant, or much paler than that of the colorant of the same hue by fabricating the writing implement such that the liquid-for-ink and the colorant are stored separately, and that the colorant is added to the liquid-for-ink while the liquid-for-ink is introduced to the writing tip, thereby the writing implement appearing definitely different from the conventional one even though it can write with predetermined color at the writing tip.

DISCLOSURE OF INVENTION

The first invention of the present invention relates to a writing implement, in which liquid-for-ink (50) and a main part of colorant (60) for coloring the liquid-for-ink (50) are separately stored, and in which the colorant (60) is added to the liquid-for-ink (50) while the liquid-for-ink (50) is introduced to a writing tip (70).

Here, the "liquid-for-ink (50)" means a substance corresponding to a conventional vehicle of ink, that is, a substance which mainly consists of a portion of the conventional ink other than dye or pigment. Moreover, the "colorant (60)" means a substance corresponding to dye or pigment of the conventional ink, that is, a substance which mainly consists of a portion of the conventional ink other than a vehicle. Namely, the ink substantially the same as the conventional one may be prepared by adding the "colorant (60)" to the "liquid-for-ink (50)".

As to the "liquid-for-ink (50)," for example, the vehicle of the conventional ink can be used as it is. Thereby the liquid-for-ink (50) can be prepared to be colorlessly-transparent or colorlessly-translucent. Moreover, the colorlessly-transparent or colorlessly-translucent liquid-for-ink (50) can also be prepared either by adding a predetermined ingredient to a vehicle of the conventional ink or by removing a predetermined ingredient from the vehicle of the conventional ink, for example. Moreover, a colorfully-transparent or colorfully-translucent liquid-for-ink (50) can also be prepared either by dissolving or dispersing an extremely small amount of dye or pigment in a vehicle of the conventional ink, for example. This allows for preparation of extremely pale-colored liquid-for-ink (50), which is of the same hue as that of the colorant (60), for example. Moreover, liquid-for-ink (50) having extremely pale color of a different hue from that of the colorant (60) can also be prepared, for example. Furthermore, the way of preparing the liquid-for-ink (50) depends on the appearance required.

Moreover, a vehicle as liquid-for-ink (50) can be prepared by appropriately blending, for example, water, water-soluble organic solvent, lubricant, preservative, anti-corrosive, pH-controlling agent, anti-drying agent, thickener, emulsion, etc.

As the "colorant (60)", dye or pigment for the conventional ink can be used as it is, for example. This allows for preparation of colorant (60) in solid form or in highly-concentrated liquid form. Moreover, colorant (60) in highly-concentrated liquid form can also be prepared by dissolving or dispersing an extremely large amount of dye or pigment in a vehicle for the conventional ink, for example. Moreover, colorant (60) in highly-concentrated liquid form can also be prepared by dissolving or dispersing an extremely large amount of dye or pigment in a predetermined ingredient of a vehicle for the conventional ink, for example. Furthermore, the way of preparing the colorant (60) depends on the way of addition of the colorant (60) to the liquid-for-ink (50).

Moreover, with respect to the colorant (60), dye such as, for example, direct dye, acid dye, basic dye, fluorescent dye, food color or the like can be used.

Moreover, with respect to the colorant (60), pigment such as, for example, inorganic pigment, organic pigment, inorganic fluorescent pigment, an organic fluorescent pigment or the like can be used.

Moreover, the "main part of the colorant (60)" is a concept including either a whole of the colorant (60) or a major part of the colorant (60).

Furthermore, as to the water, the water-soluble organic solvent, the lubricant, the preservative, the anti-corrosive, the pH-controlling agent, the anti-drying agent, the thickener, the emulsion, the direct dye, the acid dye, the basic dye, the fluorescent dye, the food color, the inorganic pigment, the organic pigment, the inorganic fluorescent pigment, and the organic fluorescent pigment, detailed description will be made later in the Best Mode for Carrying Out the Invention.

Moreover, the "writing tip (70)" means, for example, a pen tip in case of a fountain pen, a ballpoint pen tip (71) in case of a ballpoint pen, a writing point made of felt in case of a felt pen, a writing point made of a fiber bundle in case of a fiber pen (a marking pen), and a writing point made of a narrow tube in case of a needle pen. Namely, since the writing implements for the present invention are not limited to the above-described ones, the writing tips (70) are also not limited to the above-described ones.

Moreover, the description that "liquid-for-ink (50) and a main part of colorant (60)" "are separately stored" means that the liquid-for-ink (50) and the main part of the colorant (60) included in the ink are separated and independently contained within the writing implement.

Moreover, the description that "the colorant (60) is added to the liquid-for-ink (50) while the liquid-for-ink (50) is introduced to a writing tip (70)" means that the colorant (60) in solid form is gradually dissolved and added to the liquid-for-ink (50) while the liquid-for-ink (50), in the way to the writing tip (70), passes through a part where the colorant (60) in solid form is accommodated; that the colorant (60) in liquid form is gradually mixed and added to the liquid-for-ink (50) while the liquid-for-ink (50), in the way to the writing tip (70), passes through a part where the colorant (60) in liquid form is accommodated; or that the colorant (60) in liquid form is directly added to the liquid-for-ink (50) while the liquid-for-ink (50) is introduced to the writing tip (70).

Then, it becomes possible to provide a writing implement wherein the color of the liquid-for-ink (50) is made to be, for example, colorlessly-transparent, or different from that of the colorant (60) or much paler than that of the colorant (60) of the same hue by fabricating the writing implement such that the liquid-for-ink (50) and the colorant (60) are stored separately, and that the colorant (60) is added to the liquid-for-ink (50) while the liquid-for-ink (50) is introduced to the writing tip (70), thereby the writing implement appearing definitely different from the conventional one even though it can write with predetermined color at the writing tip (70).

Moreover, the second invention of the present invention is, in addition to the construction of the first invention, characterized in that a colorant-moving-direction-restricting member (80) which restricts the movement of the colorant (60) toward the liquid-for-ink (50) is provided between the liquid-for-ink (50) and the colorant (60).

Here, the "colorant-moving-direction-restricting member (80)" means that a member which is provided between the liquid-for-ink (50) and the colorant (60) in order to restrict the movement of the colorant (60) toward the liquid-for-ink (50) and not to prevent the liquid-for-ink (50) from moving toward the colorant (60).

Moreover, the concept "to restrict" includes both the concept to prevent the colorant (60) from mixing into the liquid-for-ink (50), and the concept to make it difficult that the colorant (60) mixes into the liquid-for-ink (50). Therefore, it is preferable that the materials used for the colorant-moving-direction-restricting member (80) can absolutely prevent the colorant (60) from mixing into the liquid-for-ink (50), but the materials used therefor may not be limited to such kind of materials.

Moreover, the colorant-moving-direction-restricting member (80) can be made by using a valve, or a filter in its broad sense, for example.

Moreover, as the filter, a semi-permeable membrane (81), a hollow fiber membrane, a membrane filter, a column for liquid chromatography (an ion-exchanging resin), or a moisture permeable waterproof material (for example, GORE-TEX (trademark, W. L. Gore & Associates Inc.)) can be used, for example.

Then, as described above, the colorant (60) can hardly move toward the liquid-for-ink (50) because the colorant-moving-direction-restricting member (80) is provided between the liquid-for-ink (50) and the colorant (60), so that it becomes possible to continuously keep an appearance definitely different from conventional writing implements for a long time.

Further, the third invention of the present invention is, in addition to the construction of the first or second invention, characterized in that liquid-insoluble substance (90) is included in the liquid-for-ink (50).

Here, the "liquid-insoluble substance (90)" means a solid material which is not dissolved in the liquid-for-ink (50).

The liquid-insoluble substance (90) can be formed of, for example, a thin plastic sheet, a small plastic object, a thin metal film, a small metal object, metal powder, or a small glass object.

Then, when the small plastic objects, the metal powder, or the small glass objects as described above are included in the liquid-for-ink (50), for example, the objects flutter in the liquid-for-ink (50) at the time of writing or the like, so that it becomes possible to make the appearance of the writing implement very interesting.

Moreover, if the thin plastics sheets to which trademarks, company names, or characters are applied are included within the liquid-for-ink (50), for example, letters which could not be read out in the conventional ink can be visualized, so that it becomes possible to fabricate a writing implement with an extremely high degree of advertising effectiveness.

The fourth invention of the present invention relates to a writing implement, wherein liquid-for-ink 50 and colorant 60 for coloring the liquid-for-ink 50 are stored separately, wherein the colorant 60 is added to the liquid-for-ink 50 while the liquid-for-ink 50 is introduced to a writing tip 70, and wherein a material with a capillary activity is incorporated between liquid-for-ink-storing portion and a colorant-storing portion in order to retard the diffusion of the colorant 60 into the liquid-for-ink 50.

Here, as the "material with a capillary activity," material obtained by tying and processing fibers into a bundle, resin-molded material whose inside portion is given a capillary activity, or resin-molded material whose outside portion is given a capillary activity can be used. The "material with a capillary activity" functions as the "colorant-moving-direction-restricting member" because the colorant can hardly pass through the "material with a capillary activity".

Moreover, when the writing implement is, not used for writing, left for a long time, there occurs a risk that the colorant 60 diffuses into the liquid-for-ink 50 and that the writing implement appears not so much different from the conventional ones. Thus, a material with a capillary activity is incorporated in a coupling portion between the liquid-for-ink 50 and the colorant 60 for the purpose of adsorbing the colorant while the colorant diffuses, so that it becomes possible to delay the diffusion time of a dye, and that the writing implement appears definitely different from the conventional ones for a long time.

Moreover, the fifth invention is, in addition to the construction of the fourth invention, characterized in that the material with a capillary activity is directly provided between the liquid-for-ink-storing portion and the colorant-storing portion.

Furthermore, the description that "the material with a capillary activity is directly provided between the liquid-for-ink-storing portion and the colorant-storing portion" herein means that one end of the material with a capillary activity is in contact with the liquid-for-ink-storing portion, and that the other end or some midpoints of the material with a capillary activity is in contact with the colorant-storing portion. Besides, additional portions can be interposed between the liquid-for-ink-storing portion and the colorant-storing portion to make a structure such as an ink-storing portion, a material with a capillary activity, a cavity (an ink fountain), and a colorant-storing portion.

Moreover, the sixth invention is, in addition to the construction of the fourth invention, characterized in that the material with a capillary activity is divided and provided between the liquid-for-ink-storing portion and the colorant-storing portion.

The description that "the material with a capillary activity is divided and provided between the liquid-for-ink-storing portion and the colorant-storing portion" means that a whole length of the material with a capillary activity is divided into a plurality of sections. Thus the colorant 60 is captured not only in a plurality of divided portions of the material with a capillary activity, but also on divided faces thereof, thereby a capturing efficiency being improved.

The seventh invention is, in addition to the construction of the sixth invention, characterized in that the divided material with a capillary activity consists of a combination of a plurality of materials with different capillary activities.

Moreover, the description that "the divided material with a capillary activity consists of a combination of a plurality of materials with different capillary activities" means that a whole length of the material with a capillary activity is divided into a plurality of sections and that a capillary activity of each section thus obtained is made different from the other or capillary activities of some sections thus obtained are made different from the other. Thus, the divided face which has a different capillary activity captures a large amount of colorant 60, so that the efficiency of capturing the colorant 60 is further improved.

The eighth invention is, in addition to the construction of the fourth, fifth, sixth or seventh invention, characterized in that the colorant-storing portion is made by a colored-liquid-introducing core which is impregnated with the colorant, and that the material with a capillary activity is made by a captured-liquid-introducing core which, though introducing the liquid-for-ink to a colored-liquid-storing portion, captures the colorant while the colorant moves toward the liquid-for-ink.

Further, the description that "the colorant-storing portion is made by a colored-liquid-introducing core which is impregnated with the colorant, and wherein the material with a capillary activity is made by a captured-liquid-introducing core which, though introducing the liquid-for-ink to a colored-liquid-storing portion, captures the colorant while the colorant moves toward the liquid-for-ink" means that the conventional introducing core is divided into sections, that the section near to the tip end is impregnated with the colorant to be the colored-liquid-introducing core 40, and that the section near to the rear end is so formed as to introduce the liquid-for-ink 50 to the colored-liquid-introducing core 40 as well as to prevent the colorant 60 from moving toward the liquid-for-ink 50. Thus, the above structure can be readily applicable to the conventional writing implements.

The ninth invention relates to a writing implement, wherein liquid-for-ink 50 and colorant 60 for coloring the liquid-for-ink 50 are stored separately, wherein the colorant 60 is added to the liquid-for-ink 50 while the liquid-for-ink 50 is introduced to a writing tip 70, and wherein a substance whose surface, at least, is porous is incorporated either in the liquid-for-ink, in a connecting portion between the liquid-for-ink and the colorant, or in both of the liquid-for-ink and the connecting portion, in order to prevent the colorant 60 from diffusing into the liquid-for-ink 50 as time passes.

Here, the "substance whose surface is porous" means a substance which has a lot of minute pores therein, resulting that the substance has a large inner surface area, and is widely used as an adsorbent. For example, activated carbon, zeolite, silica gel, alumina, ion-exchanging resins, and other high polymers can be used as the substance. Moreover, the "substance whose surface is porous" functions as the "colorant-moving-direction-restricting member" because the colorant can hardly pass through the substance.

The tenth invention is, in addition to the construction of the ninth invention, characterized in that the substance whose surface, at least, is porous is directly positioned between the liquid-for-ink and the colorant.

The eleventh invention is, in addition to the construction of the ninth invention, characterized in that an introducing The invention described in claim 11 is, in addition to the construction of the invention described in claim 9, characterized in that an introducing core for the liquid-for-ink is positioned between the liquid-for-ink and the colorant, and wherein the substance whose surface, at least, is porous is positioned either between the liquid-for-ink and the introducing core, or between the introducing core and the colorant.

Moreover, when the writing implement is, not used for writing, left for a long time, there occurs a risk that the colorant 60 diffuses into the liquid-for-ink 50 and that the writing implement appears not so much different from the conventional ones. Thus, a substance whose surface, at least, is porous is incorporated either in the liquid-for-ink 50, in the storing portion of the colorant 60, in the connecting portion between the liquid-for-ink 50 and the colorant 60, or in a combination thereof, for the purpose of adsorbing the colorant when the colorant diffuses, so that it becomes possible to adsorb the diffused colorant, and that the writing implement appears definitely different from the conventional ones for a long time.

Here, the substance whose surface, at least, is porous is used for adsorbing the colorant 60, and it is possible to use any substances which can adsorb the colorant 60. In terms of a type of the substance, the substance of a granular type, a particulate type, a powder type, a fiber type, or processed type thereof, can be used, for example.

Moreover, as a way of incorporating the substance whose surface, at least, is porous, the substance either of the powder type, of the particulate type, of the granular type, or of the fiber type is directly incorporated into the liquid-for-ink-storing portion of the writing implement, and consequently, the colorant 50 which is diffused into the liquid-for-ink 60 can be adsorbed by the substances. In this case, the liquid-for-ink can keep its colorlessly-transparent appearance for a long time.

Moreover, the substance either of the fiber type, of the powder type, or of the granular type can be appropriately processed and the processed substance can be incorporated into the connecting portion between the liquid-for-ink-storing portion and the colorant-storing portion, and consequently, the colorant 50 which is diffused from the colorant-storing portion into the liquid-for-ink 60 can be adsorbed by the substance. In this case, the liquid-for-ink 60 can keep its colorlessly-transparent appearance, or its extremely pale color when the liquid-for-ink 60 is slightly colored, for a long time.

At this time, furthermore, in terms of a position of the substance whose surface, at least, is porous, the substance can be directly positioned between the liquid-for-ink 60 and the colorant 50. Moreover, the introducing core of the liquid-for-ink 60 is positioned between the liquid-for-ink 60 and the colorant 50, and consequently, the substance can be positioned between the liquid-for-ink 60 and the introducing core or between the introducing core and the colorant 50.

BEST MODE FOR CARRYING OUT THE INVENTION

The best mode of the present invention will now be described with reference to the first embodiment to the third embodiment, and overlapping descriptions among respective embodiments are omitted by indicating thereof.

(First Embodiment)

An embodiment of a writing implement according to the present invention will be described below with reference to illustrations.

Figure 1:
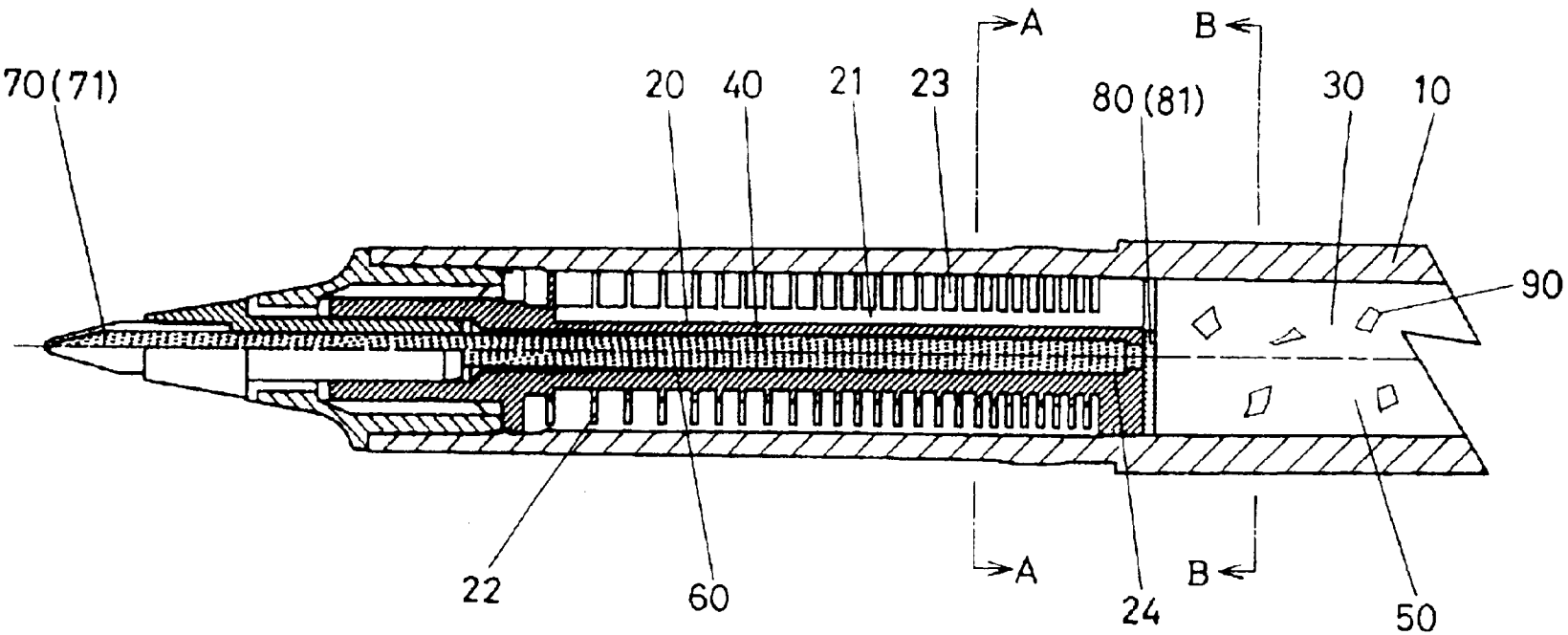
FIG. 1 is a side-sectional view of an essential part of a writing implement according to the first embodiment of the present invention.
Figure 2:
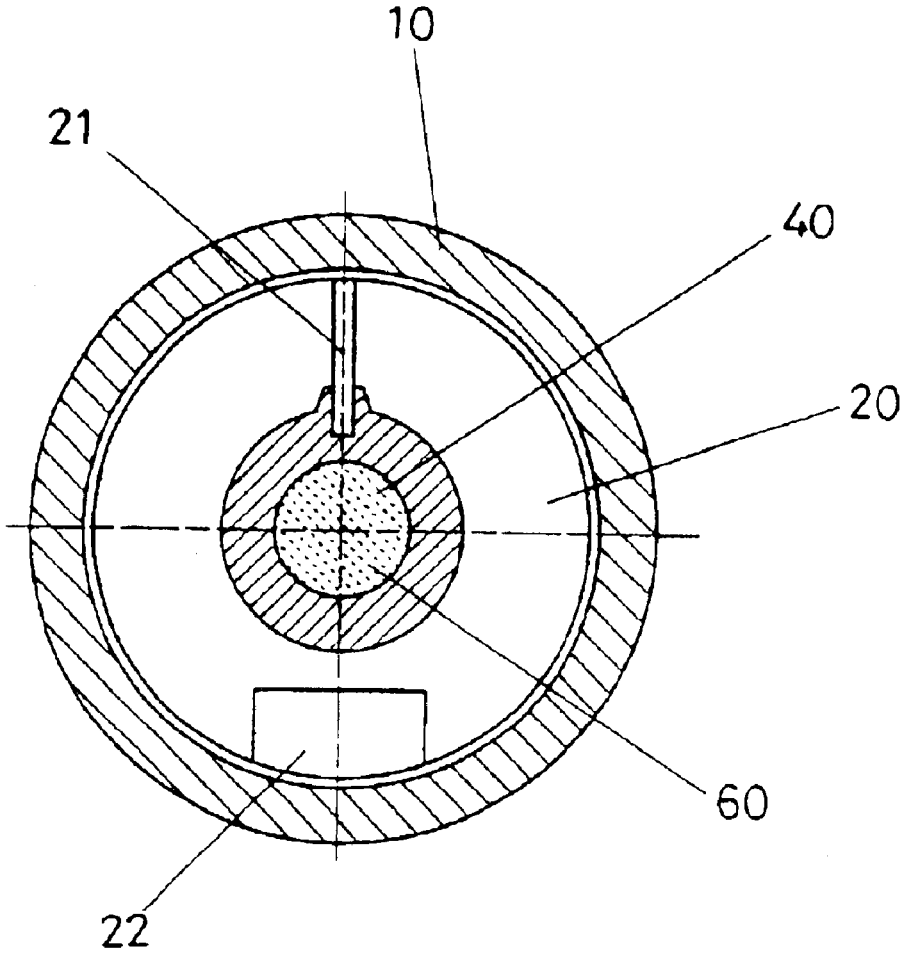
FIG. 2 is a sectional view taken along line A—A in FIG.
Figure 3:
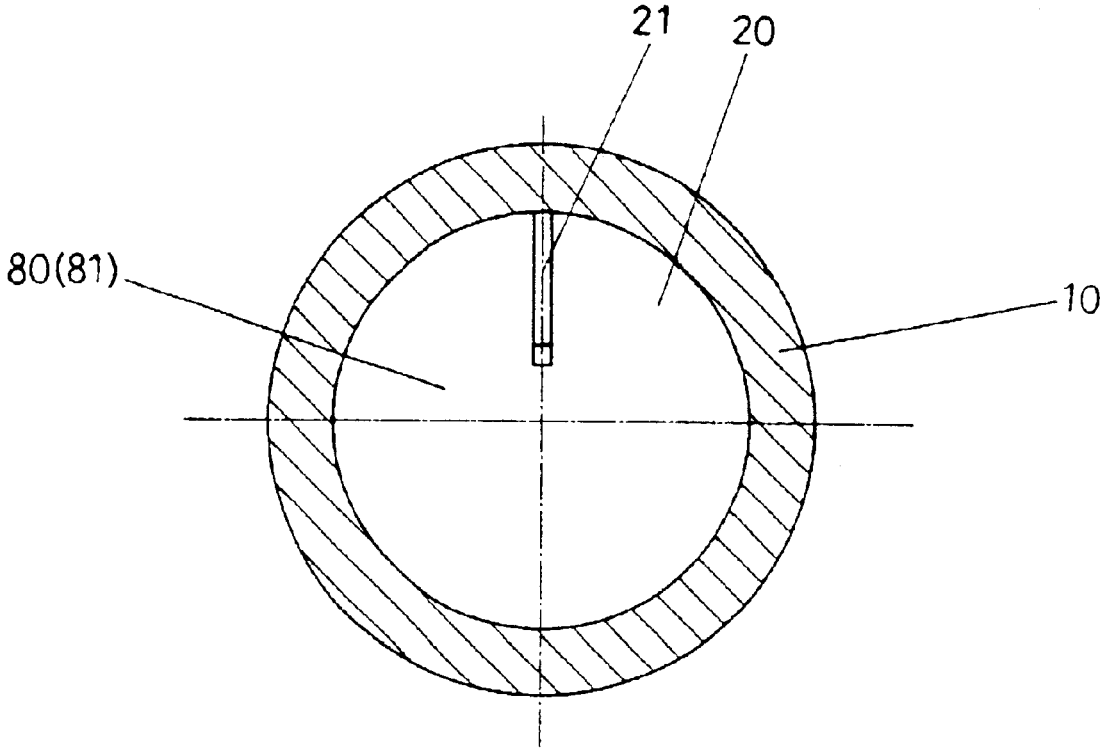
FIG. 3 is a sectional view taken along line B—B in FIG. 1.

FIG. 1 is a side-sectional view of an essential part of a writing implement according to the first embodiment of the present invention, FIG. 2 is a sectional view taken along line A—A in FIG. 1, and FIG. 3 is a sectional view taken along line B—B in FIG. 1.

As shown in FIG. 1, the writing implement according to the present invention comprises a cylindrical shaft tube 10, and a liquid-storing cell 30 for storing liquid-for-ink 50 is formed at an end inside the shaft tube 10. Moreover, a collector 20 for adjusting a pressure change within the liquid-storing cell 30 is inserted at another end inside the shaft tube 10.

Moreover, a ballpoint pen tip 71 as a writing tip 70 is fixed at an end of the collector 20*a* opposite to the liquid-storing cell 30.

Moreover, a liquid-introducing channel 24 is provided at a center of the collector 20, which penetrates from an end of the collector 20 near to the liquid-storing cell 30, to another end near to the writing tip 70.

Moreover, a liquid-introducing core 40 for introducing the liquid-for-ink 50 from the liquid-storing cell 30 to the writing tip 70 is inserted into the liquid-introducing channel 24.

Further, a semi-permeable membrane 81 as a colorant-moving-direction-restricting member 80 is provided between the liquid-introducing channel 24 and the liquid-storing cell 30, specifically, at an end of the liquid-introducing channel 24 near to the liquid-storing cell 30.

Then, the writing implement according to the present embodiment stores the liquid-for-ink 50 and the colorant 60 separately, by filling the liquid-storing cell 30 with the liquid-for-ink 50 as well as by impregnating the liquid-introducing core 40 with the colorant 60.

Moreover, the writing implement according to the present embodiment is so fabricated that the liquid-for-ink 50 penetrates to the writing tip 70 through the liquid-introducing core 40 which has been impregnated with the colorant 60, and consequently the colorant 60 is added to the liquid-for-ink 50 while the liquid-for-ink 50 is introduced to the writing tip 70.

Moreover, the writing implement according to the present invention is provided with a semi-permeable membrane 81 as a colorant-moving-direction-restricting member 80 between the liquid-introducing channel 24 and the liquid-storing cell 30, and consequently, the movement of the colorant 60 toward the liquid-for-ink 50 is restricted.

Moreover, the writing implement according to the present invention is so fabricated that the liquid-for-ink 50 includes, for example, thin plastic sheets, small plastic objects, or thin metal films as liquid-insoluble substance 90, which flutter in the liquid-for-ink 50 at the time of writing or the like.

Further, the writing implement according to the present embodiment will be described in detail as follows.

(Shaft Tube 10)

As shown in FIGS. 1 to FIG. 3, the shaft tube 10 is approximately formed cylindrically, and a liquid-storing cell 30 for storing liquid-for-ink 50 is formed at an end inside the shaft tube 10. Moreover, a collector 20 for adjusting a pressure change within the liquid-storing cell 30 is inserted into another end inside the shaft tube 10.

Moreover, the shaft tube 10 as a whole is formed to be colorlessly-transparent by using synthetic resins such as polypropylene (PP) as raw materials, and consequently the inside of the shaft tube 10 can be seen from outside.

The shaft tube 10 is not always formed in a cylindrical shape, and, for example, a periphery of the shaft tube 10 may be formed in a polygonal shape.

Materials used for forming the shaft tube 10 are not limited to polypropylene (PP); therefore, vinyl-based resin such as polyvinylchloride (PVC), polyvinylbutyral (PVB), polyvinylalcohol (PVA), polyvinylidenechloride (PVdC), polyvinylacetate (PVAc), polyvinylformal (PVF) or polyvinyldichloride, polystyrene-based resin such as polystyrene (PS), styrene acrylonitrile copolymer (AS) or ABS, polyethylene-based resin such as ethylene-vinylacetate copolymer (EVA), acrylic resin such as polymethylmethacrylate (PMMA) or modified acrylic resins, fluororesin such as polychlorotrifluoroethylene (PCTFE), polytetrafluoroethylene (PTFE), tetrafluoroethylene-hexafluoropropylene copolymer (FEP) or polyvinylidene fluoride (PVdF), polyacetal (PA), polycarbonate (PC), phenoxy resin, polyester (PETP), polyurethane (PU), phenol-formaldehyde resin (PF), urea resin (UF), melamin-formaldehyde resin (MF), epoxy resin (EP), furan resin (FF), xylene resin(XF), silicone resin or nylon can also be used, for example.

Moreover, the shaft tube 10 may not necessarily be formed colorlessly-transparent, and may be formed, for example, colorfully-transparent or translucent.

Moreover, the shaft tube 10 may not necessarily be transparent as a whole, and may be, for example, so made that the inside of the shaft tube 10 can be seen from outside by providing a transparent window at a portion of the shaft tube 10. Moreover, letters, figures, or patterns can be applied to a surface of the shaft tube 10.

Namely, the shaft tube 10 maybe so formed that the inside of the shaft tube 10 can be seen from outside.

(Collector 20)

The collector 20 is used for adjusting a pressure change within the liquid-storing cell 30.

Moreover, the collector 20 as a whole is formed colorlessly-transparent by using synthetic resins such as acrylonitrile-butadiene-styrene copolymer (ABS) or polypropylene (PP) as raw materials.

Moreover, as shown in FIGS. 1 to 3, a periphery of the collector 20 is provided with a liquid-introducing groove 21 formed from an end near to the writing tip 70, an air groove 22 formed from an end near to the writing tip 70 to the liquid-storing cell 30, and a plurality of liquid-reserving grooves 23 so formed as to intersect with both of the liquid-introducing groove 21 and the air groove 22. Thus, the leakage of the liquid-for-ink 50 from the writing tip 70 due to the pressure change within the liquid-storing cell 30 is prevented and regulated.

Moreover, as shown in FIGS. 1 and 2, at a center of the collector 20, a liquid-introducing channel 24 whose cross sectional view is circular penetrates from an end near to the liquid-storing cell 30 to another end near to the writing tip 70. A liquid-introducing core 40, described later in detail, is inserted into the liquid-introducing channel 24. Then, the liquid-for-ink 50 is introduced from the liquid-storing cell 30 to the writing tip 70, thereby. Moreover, by impregnating the liquid-introducing core 40 with the colorant 60, the colorant 60 is stored separately from the liquid-for-ink 50. Further, the colorant 60 is thus added to the liquid-for-ink 50 while the liquid-for-ink 50 is introduced into the writing tip 70.

Furthermore, the collector 20 may not necessarily be formed colorlessly-transparent, and may be formed, for example, colorfully-transparent, translucent or opaque. Namely, the collector 20 may be so formed that the inside thereof can be, or cannot be, seen from outside.

Moreover, the liquid-introducing channel 24 is not limited to be so formed that a cross sectional view of the channel becomes circular, but an inner periphery thereof may be made polygonal, for example. Moreover, an inner peripheral surface of the liquid-introducing channel 24 can be provided with a plurality of grooves which are continuously positioned from an end near to the liquid-storing cell 30 to another end near to the writing tip 70.

Moreover, the liquid-introducing core 40 may not necessarily be inserted into the liquid-introducing channel 24. In this case, however, it is preferable that an inner diameter of the liquid-introducing channel 24 is formed to an extent in which capillarity can be recognized and an inner peripheral surface of the liquid-introducing channel 24 is provided with a plurality of capillary grooves which are continuously positioned from an end near to the liquid-storing cell 30 to another end near to the writing tip 70.

(Liquid-Introducing Core 40)

The liquid-introducing core 40 is used for introducing the liquid-for-ink 50 from the liquid-storing cell 30 to the writing tip 70.

As shown in FIGS. 1 and 2, the liquid-introducing core 40 is formed like a cylindrical column by a fiber bundle.

Moreover, the liquid-introducing core 40 is inserted into the liquid-introducing channel 24 of the collector 20. An end of the liquid-introducing core 40 is positioned in the vicinity of the liquid-storing cell 30, and another end inside the ballpoint pen tip 71 as a writing tip 70.

Moreover, it is preferable that a fiber bundle whose porosity is 40% or more is used for the liquid-introducing core 40. In the case of the conventional writing implements, a fiber bundle whose porosity is 30% or more has been used for an ink-introducing core. In the present embodiment, however, the fiber bundle as the liquid-introducing core 40 is impregnated with the colorant 60.

Furthermore, the liquid-introducing core 40 is not limited to be formed of the fiber bundle, but the liquid-introducing core 40 may also be formed of a porous body, for example.

Moreover, the liquid-introducing core 40 may be formed by using a synthetic resin such as polyacetal, polypropylene, or polyester. In this case, however, it is preferable that an outer peripheral surface of the liquid-introducing core 40 is provided with a multiplicity of capillary grooves, slits, or concave portions which are continuously positioned from an end near to the liquid-storing cell 30 to another end near to the writing tip 70. Otherwise, an inside of the liquid-introducing core 40 is preferably provided with a multiplicity of capillary grooves, capillary channels, or concave portions which penetrate from an end near to the liquid-storing cell 30 to another end near to the writing tip 70.

(Writing Tip 70)

The writing tip 70 is formed of a ballpoint pen tip 71.

Moreover, the ballpoint pen tip 71 as a writing tip 70 rotatably holds a ball at an end thereof, and another end thereof is fixed to the collector 20.

Moreover, an end of the liquid-introducing core 40 is inserted into an inside of the ballpoint pen tip 71 as a writing tip 70, so that the liquid-for-ink 50 is introduced from the liquid-storing cell 30 to the ball.

Furthermore, the writing tip 70 is not limited to be formed of the ballpoint pen tip 71, but may also be formed of a pen tip for a fountain pen, of felt, of a fiber bundle, or of a fine tube for a needle pen, for example.

(Liquid-for-Ink 50)

The liquid-for-ink 50 corresponds to a vehicle of the conventional ink, and is mainly composed of a part obtained by removing dye or pigment from the conventional ink.

For example, using the vehicle of the conventional ink as it is, liquid-for-ink 50 which is colorlessly-transparent or translucent can be prepared.

Moreover, by adding a predetermined component to the vehicle of the conventional ink, or by removing a predetermined component from the vehicle of the conventional ink, liquid-for-ink 50 which is colorlessly-transparent or translucent can be prepared.

Moreover, the liquid-for-ink 50 which is colorfully-transparent or colorfully-translucent can also be prepared by dissolving or dispersing an extremely small amount of dye or pigment in a vehicle of the conventional ink. Thus, liquid-for-ink 50 whose color is extremely pale and of the same hue as that of the colorant 60 can be prepared, for example. Moreover, liquid-for-ink 50 whose color is extremely pale and of a different hue from that of the colorant 60 can also be prepared, for example.

Specifically, the liquid-for-ink 50 can be prepared by appropriately blending, for example, water, water-soluble organic solvent, lubricant, preservative, anti-corrosive, pH-controlling agent, anti-drying agent, thickener, an emulsion or the like. Further, an extremely small amount of dye or pigment, described later in detail, may also be dissolved or dispersed in the substances.

Then, the liquid-storing cell 30, which is provided at an end inside the shaft tube 10, is filled with the liquid-for-ink 50.

Furthermore, the way of preparing the liquid-for-ink 50 depends on the appearance desired.

Further, water, water-soluble organic solvent, lubricant, preservative, anti-corrosive, pH-controlling agent, anti-drying agent, thickener, emulsion and the like used for preparing the liquid-for-ink 50 will be described in detail as follows.

(Water)

As to the water, purified water, distilled water, or ion-exchanged water can be used, for example.

(Water-Soluble Organic Solvent)

As to the water-soluble organic solvent, for example, (1) alcohols such as isopropyl alcohol and butyl alcohol, (2) ketones such as acetone andmethyl ethyl ketone, (3) ethers such as tetrahydrofuran and dioxane, (4) esters such as ethyl acetate and propylene carbonate, (5) polyhydric alcohols such as ethylene glycol, propylene glycol, butylene glycol, diethylene glycol, triethylene glycol, polyethylene glycol, polypropylene glycol, 1,5-pentanediol, 1,2,6-hexanetriol, thiodiglycol, and glycerol, (6) lower alkyl ethers of polyhydric alcohols such as ethylene glycol monomethylether, ethylene glycol dimethylether, ethylene glycol monoethylether, ethylene glycol diethylether, ethylene glycol mono-n-propylether, and ethylene glycol monoisopropylether, (7) nitrogeneous compounds such as urea, pyrrolidone, and N-methyl-2-pyrrolidone, (8) sulfur-containing compounds such as dimethyl sulfoxide and tetramethylene sulfoxide, (9) glycerin derivatives such as ethylene oxide adducts of polyglycerin, etc. can be used.

Each of the solvents may be used alone or in combination with any one or more of these solvents.

Although a total amount of the solvent to be used is not specifically limited, it is preferable that an amount of an auxiliary solvent is within a range from 0.5 to 50% by weight.

(Lubricant)

As to the lubricant, for example, phosphate esters of polyoxyethylene alkyl ethers, phosphate esters of polyoxyethylene alkyl allyl ethers, potassium linoleate, sodium ricinate, potassium oleate, sodium oleate, glycerine fatty acid esters, polyglycerin fatty acid esters, propylene glycol fatty acid esters, pentaerythritol fatty acid esters, polyoxyethylene sorbitan fatty acid esters, pentaerythritol fatty acid esters, polyoxyethylene sorbitan fatty acid esters, polyoxylethylene sorbit fatty acid esters, polyoxyethylene glycerin fatty acid esters, polyethylene glycol fatty acid esters, polyoxyethylene alkyl ethers, polyoxyethylene phytosterol, polyoxyethylene polyoxypropylene alkyl ethers, polyoxyethylene alkyl phenyl ethers, polyoxyethylene castor oil, polyoxyethylene lanolin, polyoxyethylene lanolin alcohols, polyoxyethylene alkylamine, polyoxyethylene fatty acid amides, polyoxyethylene alkyl phenyl formaldehyde condensates, etc. can be used.

Furthermore, each of the lubricants may be used alone or in combination with any one or more of the lubricants.

(Preservative)

As to the preservative, for example, sodium dehydroacetate, 1,2-benzothiazoline-3-one, sodiumbenzoate, 2-pyridinethiol-1-oxide sodium salt, phenol, etc. can be used.

Each of the preservatives may be used alone or in combination with any one or more of the preservatives.

(Anti-Corrosive)

As to the anti-corrosive, for example, tolyltriazole, benzotriazole and derivatives thereof, fatty acid phosphorus derivatives such as octyl phosphate and dioctyl phosphate, imidazole, benzoimidazole and derivatives thereof, benzoimidazole, 2-mercaptobenzothiazole, octyloxymethane phosphonic acid, dicyclohexylammonium nitrite, diisopropylammonium nitrite, propargyl alcohol, dialkyithiourea, etc. can be used.

Furthermore, each of the anti-corrosives may be used alone or in combination with any one or more of the anti-corrosives.

(pH-controlling Agent)

As to the pH-controlling agent, for example, sodium hydroxide, potassiumhydroxide, potassiumphosphate, calcium hydroxide, sodium carbonate, sodium hydrogen carbonate, ammonia, methylamine, dimethylamine, trimethylamine, ethylamine, diethylamine, triethylamine, propylamine, dipropylamine, tripropylamine, butylamine, dibutylamine, tributylamine, isobutylamine, diisobutylamine, 2-butaneamine, N-(1-methylpropyl)-1-propaneamine, N,N-dimethylbutylamine, 1,2-dimethylpropylamine, N-ethyl-1,2-dimethylpropylamine, allylamine, diallylamine, triallylamine, N,N-dimethylallylamine, N-methyldiallylamine, 3-pentylamine, N,N-diisopropylamine, 2-(hydroxymethylamino)ethanol, 2-aminopropanol, 3-aminopropanol, triethanolamine, monoethanolamine, diethanolamine, 2-amino-2-methyl-1-propanol, N-isobutyldiethanolamine, 3-methoxypropylamine, 3-propyloxypropylamine, 3-isopropyloxypropylamine, 3-butoxypropylamine, etc. can be used.

Furthermore, each of the agents may be used alone or in combination with any one or more of the agents.

(Anti-Drying Agent)

As to the anti-draying agent, for example, urea, thiourea, ethylene urea, reduced starch resolvents, reduced dextrin, reduced maltodextrin, etc. can be used.

Furthermore, each of the agents may be used alone or in combination with any one or more of the agents.

(Thickener)

As to the thickener, for example, gum Arabic, gum tragacanth, Locust bean gum, Cyamoposis gum and derivatives thereof, alginic acid, alginate, pectin, carageenan, gelatin, casein, casein sodium, xanthan gum, rhamsan gum, welan gum, gelan gum, dextran, methyl cellulose, ethyl cellulose, hydroxyethyl cellulose, carboxymethyl cellulose, hydroxypropyl cellulose, sodium carboxymethyl starch, lanolin derivatives, chitosan derivatives, lactalbumin, polyethylene oxide, polyethylene glycol, polyvinyl alcohol, polyvinylmethylether, polyvinylpyrrolidone and derivatives thereof, polyacrylic resin, crosslinked polyacrylic resin, polyurethane resin, acrylic resin, styrene-acrylic resin, alkali metal salts of styrene-maleic acid copolymer, etc. can be used.

Furthermore, each of the thickeners may be used alone or in combination with any one or more of these thickeners.

(Emulsion)

As to the emulsion, for example, polystyrene, polymethyl methacrylate, polyvinylchloride, polyvinylacetate, benzoguanamine resin, epoxy resin, α,β-ethylenic unsaturated acids (e.g. acrylic acid, methacrylic acid, maleic acid, etc.), acrylic acid esters and methacrylic acid esters (e.g. ethyl acrylate, propyl acrylate, butyl acrylate, methyl methacrylate, ethyl methacrylate, propylmethacrylate, butyl methacrylate, etc.), copolymer of vinyl aromatic compounds (e.g. styrene, vinyl toluene, etc.), etc. can be used.

Furthermore, each of the may be used alone or in combination with any one or more of the emulsions.

(Colorant 60)

The colorant 60 corresponds to dye or pigment of the conventional ink, and is mainly composed of a component which is obtained by removing a vehicle from the conventional ink.

For example, the colorant 60 in solid form or in liquid form of high concentration can be prepared by using the dye or pigment of the conventional ink as it is.

Moreover, for example, the colorant 60 in liquid form of high concentration can be prepared by dissolving or dispersing an extremely large amount of dye or pigment in the vehicle of the conventional ink.

Moreover, for example, the colorant 60 in liquid form of high concentration can be prepared by dissolving or dispersing an extremely large amount of dye or pigment in a predetermined component within the vehicle of the conventional ink.

Specifically, the colorant 60 can be prepared by using, for example, dyes such as direct dye, acid dye, basic dye, fluorescent dye, a food color, etc., or alternatively, pigments such as inorganicpigment, organicpigment, inorganic fluorescent pigment, an organic fluorescent pigment, etc. as it is.

Moreover, the colorant 60 can also be prepared by dissolving or dispersing a large amount of dye or pigment described above in a blend which is obtained by appropriately mixing the water, the water-soluble organic solvent, the lubricant, the preservative, the anti-corrosive, the pH-controlling agent, the anti-drying agent, the thickener, the emulsion, etc. Further in this case, for the purpose of dispersing the pigment in the blend, it is preferable that nonionic surfactant, anionic surfactant, water-soluble polymers, etc. are blended as dispersant of the pigment.

Then, the liquid-introducing core 40 is impregnated with the colorant 60 prepared in liquid form. Thus, the colorant 60 is stored within the writing implement separately from the liquid-for-ink 50.

Furthermore, the way of storing the colorant 60 within the writing implement is not limited to the impregnation into the liquid-introducing core 40. For example, the colorant 60 prepared in solid form or in liquid form may be filled into the liquid-introducing channel 24 provided at a center of the collector 20. Moreover, the colorant 60 prepared in liquid form may be applied to an inner peripheral surface of the liquid-introducing channel 24 and then solidified, for example. Moreover, the colorant 60 prepared in liquid form may be applied to an outer peripheral surface of the liquid-introducing core 40 and then solidified, for example. Moreover, the colorant 60 prepared in solid form may be embedded within the liquid-introducing core 40, for example. Further, the writing implement may be so fabricated that the colorant 60 prepared in liquid form is held in a certain portion other than the liquid-storing cell 30 and the colorant 60 is gradually added to the liquid-for-ink 50 according to flow of the liquid-for-ink 50.

Further, direct dye, acid dye, basic dye, fluorescent dye, food color, oil-soluble dye, inorganic pigment, organic pigment, inorganic fluorescent pigment, organic fluorescent pigment, nonionic surfactant, anionic surfactant, and water-soluble polymers used for preparing the colorant 60 will be described in detail as follows.

(Direct Dye)

As to the direct dye, for example, C.I. Direct Black 17, 19, 22, 32, 38, 51 and 71, C.I. Direct Yellow 4, 26, 44 and 50, C.I. Direct Red 1, 4, 23, 28, 31, 37, 39, 75, 80, 81, 83, 225, 226 and 227, C.I. Direct Blue 1, 15, 71, 86, 106 and 119, etc. can be used.

Furthermore, each of the direct dyes may be used alone or in combination with any one or more of the dyes.

(Acid Dye)

As to the acid dye, for example, C.I. Acid Black 1, 2, 24, 26, 31, 52, 107, 109, 110, 119 and 154, C.I. Solvent Black 5, C.I. Acid Yellow 7, 17, 19, 23, 25, 29, 38, 42, 49, 61, 72, 78, 110, 141, 127, 135 and 142, C.I. Acid Red 8, 9, 14, 18, 26, 27, 35, 37, 51, 52, 57, 82, 87, 92, 94, 111, 129, 131, 138, 186, 249, 254, 265 and 276, C.I. Acid Violet 15 and 17, C.I. Acid Blue 1, 7, 9, 15, 22, 23, 25, 40, 41, 43, 62, 78, 83, 90, 93, 103, 112, 113 and 158, C.I. Acid Green 3, 9, 16, 25 and 27, etc. can be used.

Furthermore, each of the acid dyes may be used alone or in combination with any one or more of the dyes.

(Basic Dye)

As to the basic dye, for example, C.I. Basic Yellow 1, 2 and 21, C.I. Basic Orange 2, 14 and 32, C.I. Basic Red 1, 2, 9 and 14, C.I. Basic Violet 1, 3 and 7, C.I. Basic Brown 12, C.I. Basic Black 2 and 8, C.I. Solvent Violet 8, C.I. Basic Green 4, C.I. Solvent Blue 2, C.I. Solvent Red 49, C.I. Basic Blue 9, etc. can be used.

Furthermore, each of the basic dyes may be used alone or in combination with any one or more of the dyes.

(Fluorescent Dye)

As to the fluorescent dye, for example, C.I. Acid Yellow 7, C.I. Basic Red 1, etc. can be used.

Furthermore, each of the fluorescent dye may be used alone or in combination with any one or more of the dyes.

(Food Color)

Although the majority of the food colors are included in the direct dyes or acid dyes, the food color, e.g. C.I. Food Yellow 3, which is not included in such dyes, can also be used.

(Oil-Soluble Dye)

As to the oil-soluble dyes, for example, VALI FAST Black 1802, VALI FAST Black 1807, VALI FAST Violet 1701, VALI FAST Violet 1702, VALI FAST Blue 1605, VALI FAST Blue 1603, VALI FAST Blue 1601, VALI FAST Red 1308, VALI FAST Red 1320, VALI FAST Red 1355, VALI FAST Red 1360, VALI FAST Yellow 1101, VALI FAST Yellow 1105, VALI FAST Green 1308, NIGROSINE Base EXBP, NIGROSINE Base EX, BASE OF BASIC DYES ROB-B, BASE OF BASIC DYES RO6G-B, BASE OF BASIC DYES VB-B, BASE OF BASIC DYES VPB-B, and BASE OF BASIC DYES MVB-3 (Orient Chemical Industries, Ltd.), and Izenspirone Black GMH-Special, Izenspirone Violet C-RH, Izenspirone Blue GNH, Izenspirone Blue 2BNH, Izenspirone Blue C-RH, Izenspirone Red C-GH, Izenspirone Red C-BH, Izenspirone Yellow C-GNH, Izenspirone Yellow C-2GH, S.P.T. Red 522, S.P.T. Blue GLSH Special, S.P.T. Red 533, S.P.T. Orange 6, S.P.T. Blue 111, S.B.N. Violet 510, S.B.N. Yellow 510, and S.B.N. Yellow 530 (Hodogaya Chemical Co. Ltd.), etc. can be used.

Furthermore, each of the dyes may be used alone or in combination with any one or more of the dyes.

(Inorganic Pigment)

As to the inorganic pigment, for example, titanium oxide, carbon black, red oxide, chromium oxide, iron black, cobalt blue, alumina white, iron oxide yellow, viridian, zinc sulfide, lithopone, cadmium yellow, vermilion, cadmium red, chrome yellow, molybdate orange, zinc chromate, strontium chromate, white carbon, clay, talc, ultramarine blue, precipitated barium carbonate, baryte powder, calcium carbonate, white lead, Prussian blue, manganese violet, aluminum powder, stainless powder, nickel powder, copper powder, zinc powder, brass powder, etc. can be used.

Furthermore, each of the pigments may be used alone or in combination with any one or more of the pigments.

(Organic Pigment)

As to the organic pigment, for example, azo lake, insoluble azo pigments, chelate azo pigments, phthalocyanine pigments, perylene and perinone pigments, anthraquinone pigments, quinacridone pigments, dye lake, nitro dyes, nitroso dyes, etc., more specifically, phthalocyanine blue (C.I. 74160), phthalocyanine green (C.I. 74260), Hanza yellow 3G (C.I. 11670), disazo yellow GR (C.I. 21100), permanent red 4R (C.I. 12335), brilliant carmine 6B (C.I. 15850), quinacridone red (C.I. 46500), etc. can be used.

Furthermore, each of the pigments may be used alone or in combination with any one or more of the pigments.

(Inorganic Fluorescent Pigment)

Inorganic fluorescent pigment, for example, obtained by adding a trace amount of activator such as copper, silver, or manganese to heavy metal salts such as zinc sulfide or to sulfides of alkali earth metals with high purity and then calcinating them at a high temperature, can be used.

(Organic Fluorescent Pigment)

As to the organic fluorescent pigment, for example, a solid solution obtained by dissolving fluorescent dye in a vehicle of synthetic resin can be used. Furthermore, the fluorescent dye herein refers to C.I. Acid Yellow 7 or C.I. Basic Red 1, for example, while the synthetic resin herein refers to vinyl chloride resin, alkyd resin, or alkali resin.

(Nonionic Surfactant)

As to the nonionic surfactant, for example, higher fatty acid esters of polyoxyalkylene, higher fatty acid partial esters of polyhydroxy alcohol, higher fatty acid esters of sugar, etc., more specifically, fatty acid esters of glycerin, polyglycerin fatty acid esters, propylene glycol fatty acid esters, pentaerythritol fatty acid esters, polyoxyethylene sorbitan fatty acid esters, polyoxylethylene sorbit fatty acid esters, polyoxyethylene glycerin fatty acid esters, polyethylene glycol fatty acid esters, polyoxylthylene alkyl ethers, polyoxyethylene phytosterol, polyoxyethylene polyoxypropylene alkyl ethers, polyoxyethylene alkyl phenyl ethers, polyoxyethylene castor oil, polyoxyethylene lanolin, polyoxyethylene lanolin alcohols, polyoxyethylene alkylamine, polyoxyethylene fatty acid amides, polyoxyethylene alkyl phenyl formaldehyde condensates, etc. can be used.

Furthermore, each of the surfactants may be used alone or in combination with any one or more of the surfactants.

(Anionic Surfactant)

As to the anionic surfactant, for example, alkylated sulfonates of higher fatty acid amide, alkylallylsulfonate, etc., more specifically, alkyl sulfates, polyixyethylene alkylether sulfates, N-acyl amino acid salts, N-acyl methyl tauline salts, polyoxyethylene alkylether acetates, alkylphosphates, polyoxyethylene alkylether phosphates, etc. can be used.

Furthermore, each of the surfactants may be used alone or in combination with any one or more of the surfactants.

(Water-Soluble Polymer)

As to the water-soluble polymer, polyacrylic acid, acrylic acid copolymers, maleic acid resin, etc., more specifically, acrylic resin, styrene-acrylic acid resin, styrene-maleic acid resin, etc., which is prepared in salt form to obtain water solubility, can be used. Furthermore, among alkali metals which form salts are sodium or potassium, and among amines which form salts are aliphatic primary to tertiary amines such as mono-, di- and tri-methylamine; alcohol amines such as mono-, di- and tri-propanolamine, methylethanolamine, methylpropanolamine, and dimethylethanolamine; ammonia; morpholine; N-methylpholine; etc.

Furthermore, each of the polymers may be used alone or in combination with any one or more of the polymers.

(Colorant-Moving-Direction-Restricting Member 80)

The colorant-moving-direction-restricting member 80 is provided between the liquid-for-ink 50 and the colorant 60 in order to restrict the movement of the colorant 60 toward the liquid-for-ink 50 and not to prevent the liquid-for-ink 50 from moving toward the colorant 60.

The colorant-moving-direction-restricting member 80 is formed of a semi-permeable membrane 81.

Moreover, as shown in FIGS. 1 and 3, the semi-permeable membrane 81 as the colorant-moving-direction-restricting member 80 is provided at an end of the liquid-introducing channel 24 near to the liquid-storing cell 30.

Thus, the semi-permeable membrane 81 as the colorant-moving-direction-restricting member 80 is located between the liquid-for-ink 50 and the colorant 60, and, consequently, the movement of the liquid-for-ink 50 toward the colorant 60 is not prevented, while the movement of the colorant 60 from the liquid-introducing channel 24 to the liquid-for-ink 50 is restricted. Then, the colorant 60 is not made to mix in the liquid-for-ink 50.

Namely, the semi-permeable membrane 81 has a great number of pores whose diameters are about 10 to 1000 angstroms, and, therefore, the majority of components constituting the liquid-for-ink 50 can flow through the pores, but the dye or pigment constituting the colorant 60 cannot flow through these pores. Therefore, the movement of the liquid-for-ink 50 toward the colorant 60 is not prevented, while the movement of the colorant 60 toward the liquid-for-ink 50 is restricted.

Moreover, as the semi-permeable membrane 81, cellophane, polyvinylalcohol membranes, bladder membranes, collodion membranes, cell membranes, or cellulose acetate membranes can be used, for example.

Furthermore, the colorant-moving-direction-restricting member 80 is not limited to be formed of the semi-permeable membrane 81, but may also be formed by, for example, a valve, a hollow fiber membrane, a membrane filter, a column for liquid chromatography (an ion-exchanging resin), or a moisture permeable waterproof material (e.g. GORE-TEX (trademark, W. L. Gore & Associates Inc.)).

Moreover, although the colorant 60 will be easily mixed with the liquid-for-ink 50, the colorant-moving-direction-restricting member 80 is not necessarily provided between the liquid-for-ink 50 and the colorant 60.

It is preferable, however, that the colorant-moving-direction-restricting member 80 is provided between the liquid-for-ink 50 and the colorant 60 for the purpose of completely or substantially preventing the colorant 60 from being mixed with the liquid-for-ink 50.

(Liquid-Insoluble Substance 90)

The liquid-insoluble substance 90 is a solid matter which is not dissolved in the liquid-for-ink 50 and is contained within the liquid-for-ink 50.

The liquid-insoluble substance 90 can be made from a thin plastic sheet, a small plastic object, a thin metal film, a small metal object, metal powder, or a small glass object, for example.

Moreover, a trademark, a company name, or characters can be applied to a surface of the thin plastic sheet as the liquid-insoluble substance 90.

Then, if the small plastic objects, the metal powders, or the small glass objects as the liquid-insoluble substances 90 are included within the liquid-for-ink 50, the objects flutter within the liquid-for-ink 50 at the time of writing. Moreover, if the thin plastic sheets to which trademarks, company names, or characters are applied are included within the liquid-for-ink 50, letters which could not be read out in the case of using the conventional ink can be visualized.

Furthermore, the liquid-insoluble substances 90 may be, or may not be, included within the liquid-for-ink 50.

Thus, the writing implement according to the present embodiment is so fabricated that the writing implement has an appearance definitely different from the conventional ones and that it can write with ink which shows a predetermined color at a writing tip 70, by storing the liquid-for-ink 50 and the colorant 60 separately and by adding the colorant 60 to the liquid-for-ink 50 while the liquid-for-ink 50 is introduced to a writing tip 70.

Moreover, the writing implement according to the present embodiment is so fabricated that the colorant 60 can hardly move toward the liquid-for-ink 50 by providing the colorant-moving-direction-restricting member 80 between the liquid-for-ink 50 and the colorant 60. Thereby, it becomes possible to continuously keep an appearance which is definitely different from the conventional writing implement for a long time.

Further, the writing implement according to the present embodiment is so fabricated that the appearance of the writing implement becomes very interesting, or that the advertising effectiveness becomes extremely higher by including the liquid-insoluble substances 90 within the liquid-for-ink 50 to flutter therewithin at the time of writing.

Furthermore, although a writing implement equipped with the collector 20 has been described in the present embodiment, the present invention is not limited to the writing implement equipped with the collector 20 and is also applicable to a direct ink type of fiber pen, marker pen, or ballpoint pen which are not equipped with collector 20, for example.

(Second Embodiment)

The fourth to eighth invention of the present invention will be described as the second embodiment in detail as follows.

Figure 4:
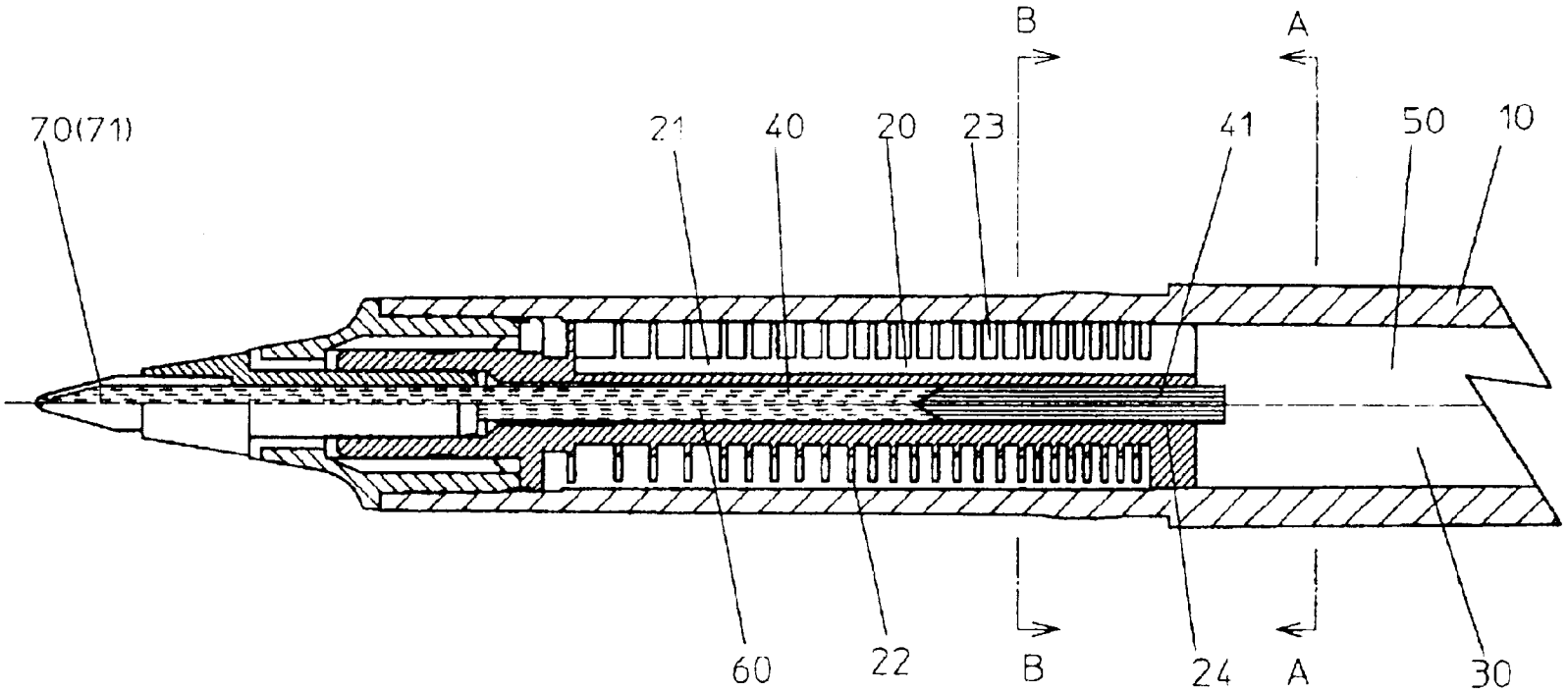
FIG. 4 is a side-sectional view of an essential part of a writing implement according to the second embodiment of the present invention.

FIG. 4 is a side-sectional view of an essential part of a writing implement according to the present embodiment.

As shown in FIG. 4, the writing implement according to the present embodiment comprises a cylindrical shaft tube. A liquid-storing cell 30 for storing liquid-for-ink 50 is formed at an end inside the shaft tube. Moreover, a collector 20 for preventing the leakage of the liquid-for-ink from a writing tip, which is due to a pressure change within the liquid-storing cell 30, is inserted into another end inside the shaft tube.

Moreover, at an end of the collector 20 opposite to the liquid-storing cell 30, a ballpoint pen tip 71 is fixed as a writing tip 70.

Moreover, at a center of the collector 20 is provided a liquid-introducing channel 24 which penetrates therethrough from an end near to the liquid-storing cell 30 to another end near to the writing tip 70.

Moreover, into the liquid-introducing channel 24 are inserted a colored-liquid-introducing core 40 and a captured-liquid-introducing core 41 for introducing the liquid-for-ink 50 from the liquid-storing cell 30 to the writing tip 70.

(Shaft Tube 10)

Figure 5:
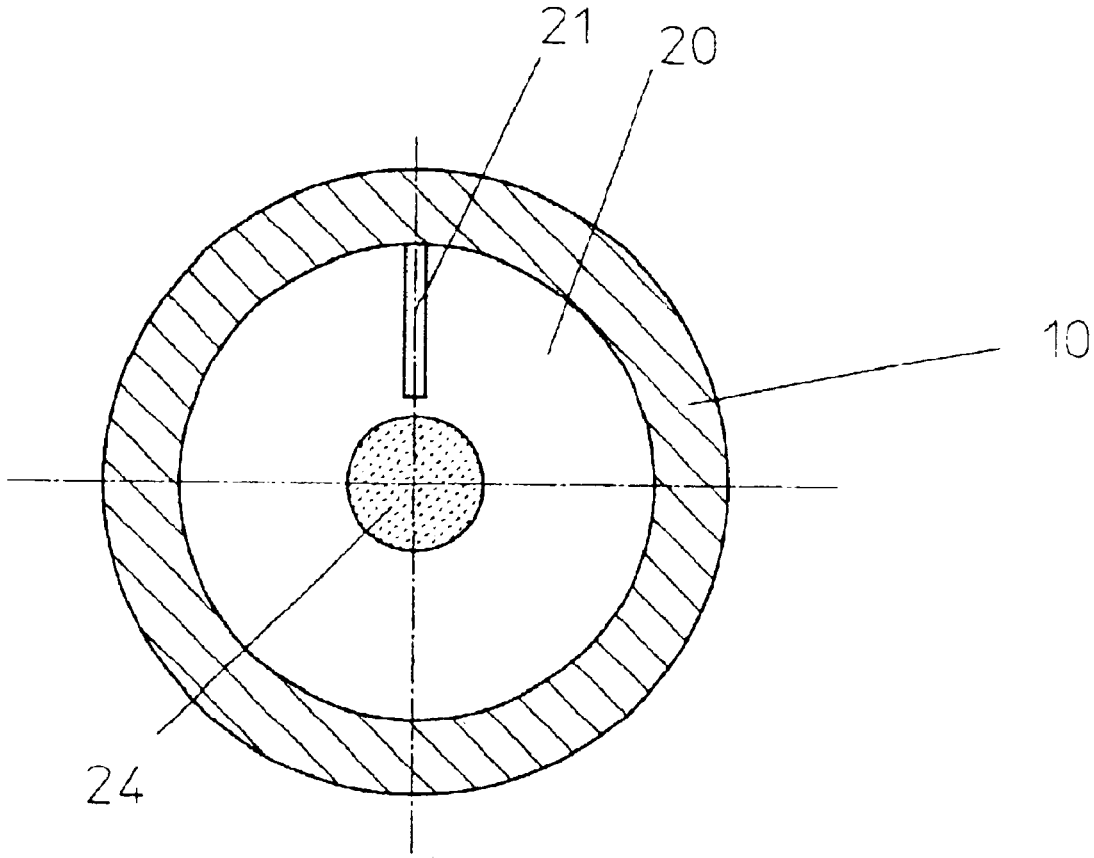
FIG. 5 is a sectional view taken along line A—A in FIG. 4.
Figure 6:
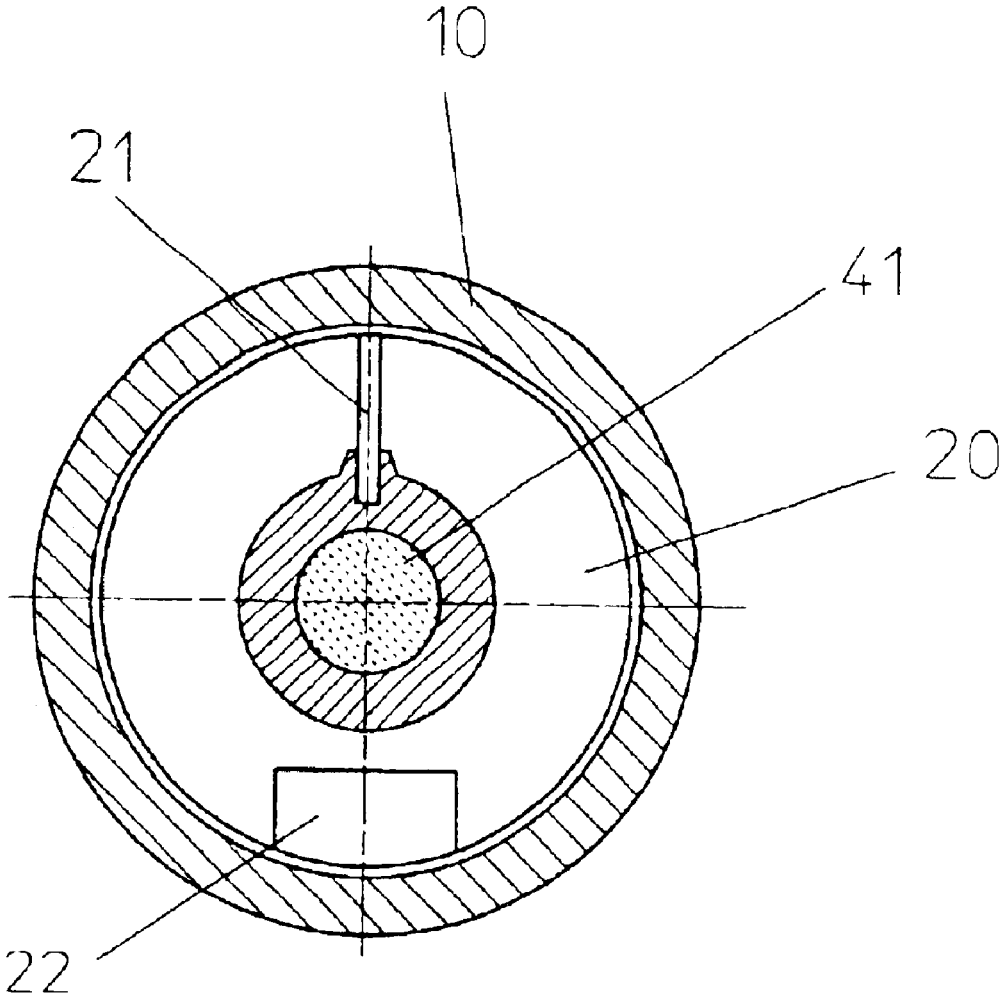
FIG. 6 is a sectional view taken along line B—B in FIG. 4.

As shown in FIGS. 4 to 6, the shaft tube 10 is substantially formed cylindrically, and a liquid-storing cell 30 for storing liquid-for-ink 50 is formed at an end inside the shaft tube 10. Moreover, a collector 20 for adjusting a pressure change within the liquid-storing cell 30 is inserted into another end inside the shaft tube 10.

Moreover, the description of the shaft tube 10 will be omitted because the description overlaps with that in the first embodiment.

(Collector 20)

The collector 20, shown in FIGS. 4 to 6, is used for adjusting a pressure change within the liquid-storing cell 30.

Moreover, a description of the collector 20, except that the collector 20 needs a liquid-introducing core 40, will be omitted because the description overlaps with that in the first embodiment.

(Colored-Liquid-Introducing Core 40 and Captured-Liquid-Introducing Core 41)

The colored-liquid-introducing core 40 and a captured-liquid-introducing core 41 are used for introducing the liquid-for-ink 50 from the liquid-storing cell 30 to the writing tip 70.

As shown in FIGS. 4 and 5, each of the colored-liquid-introducing core 40 impregnated with colorant 60 described below, and the captured-liquid-introducing core 41 for introducing the liquid-for-ink 50 to the colored-liquid-introducing core 40 as well as for preventing the colorant 60 from moving into the liquid-for-ink 50, is formed like a cylindrical column by a fiber bundle.

Moreover, the colored-liquid-introducing core 40 and the captured-liquid-introducing core 41 are inserted into the liquid-introducing channel 24 of the collector 20, with an end positioned near to the liquid-storing cell 30 and another end positioned inside a ballpoint pen tip 71 as a writing tip 70.

It is preferable that a fiber bundle whose porosity is 40% or more is used as the colored-liquid-introducing core 40 and the captured-liquid-introducing core 41. In the case of the conventional writing implements, a fiber bundle whose porosity is 30% or more has been used as an ink-introducing core. However, in the present embodiment, the fiber bundle is used because the fiber bundle as the colored-liquid-introducing core 40 is impregnated with the colorant 60. In the case, the porosity is not limited to the values, but a fiber bundle whose porosity is sufficient for introducing the liquid-for-ink 50 can be used.

The colored-liquid-introducing core 40 and the captured-liquid-introducing core 41 are not limited to be formed of a fiber bundle, and may be formed of porous bodies.

Moreover, the colored-liquid-introducing core 40 and the captured-liquid-introducing core 41 may also be made of synthetic resins such as polyacetal, polypropylene, or polyester. In this case, however, it is preferable that an outer peripheral surface of any one or both of the colored-liquid-introducing core 40 and the captured-liquid-introducing core 41 is provided with a multiplicity of capillary grooves, slits, or concave portions which are continuously positioned from an end to another of the cores 40 and 41, or that an inside of any one or both of the colored-liquid-introducing core 40 and the captured-liquid-introducing core 41 is provided with a multiplicity of capillary grooves, capillary channels, or concave portions which penetrate from an end to another of the cores 40 and 41.

Furthermore, although it has been described that the colored-liquid-introducing core 40 and the captured-liquid-introducing core 41 are in contact with each other, the other portion such as a liquid-storing portion 30, a captured-liquid-introducing core 41, a cavity (an ink fountain), a colored-liquid-introducing core 40 can be interposed between the colored-liquid-introducing core 40 and the captured-liquid-introducing core 41.

Moreover, it has been described that the captured-liquid-introducing core 41 is formed in one piece, but the core 41 can be so formed that the core 41 is divided into a plurality of sections. Thus, the colorant 60 is captured not only by an inside portion but also by a divided face of the captured-liquid-introducing core 41 which has been divided into a plurality of sections, so that a capturing efficiency is improved.

Further in this case, a capillary activity of each section of the captured-liquid-introducing core 41 can be made different from other sections. Consequently, a divided face whose capillary activity is different from other faces captures a large amount of colorant 60, so that the efficiency of capturing the colorant 60 is further improved.

(Writing Tip 70)

A description of the writing tip 70 will be omitted because the description overlaps with that in the first embodiment.

(Liquid-for-Ink 50)

A description of the liquid-for-ink 50 will be omitted because the description overlaps with that in the first embodiment.

(Colorant 60)

The colorant 60 corresponds to dye or pigment of the conventional ink, and is mainly composed of a component which is obtained by removing a vehicle from the conventional ink.

For example, the colorant 60 in solid form or in liquid form of high concentration can be prepared by using the dye or pigment of the conventional ink as it is.

Moreover, for example, the colorant 60 in liquid form of high concentration can be prepared by dissolving or dispersing an extremely large amount of dye or pigment in the vehicle of the conventional ink.

Moreover, for example, the colorant 60 in liquid form of high concentration can be prepared by dissolving or dispersing an extremely large amount of dye or pigment in a predetermined component within the vehicle of the conventional ink.

Specifically, the colorant 60 can be prepared by using, for example, dyes such as direct dye, acid dye, basic dye, fluorescent dye, a food color, etc., or alternatively, pigments such as inorganic pigment, organic pigment, inorganic fluorescent pigment, an organic fluorescent pigment, etc. as it is.

Moreover, the colorant 60 can also be prepared by dissolving or dispersing a large amount of dye or pigment described above in a blend which is obtained by appropriately mixing the water, the water-soluble organic solvent, the lubricant, the preservative, the anti-corrosive, the pH-controlling agent, the anti-drying agent, the thickener, the emulsion, etc. Further in this case, for the purpose of dispersing the pigment in the blend, it is preferable that nonionic surfactant, anionic surfactant, water-soluble polymers, etc. are blended as dispersant of the pigment.

Then, the liquid-introducing core 40 is impregnated with the colorant 60 prepared in liquid form. Thus, the colorant 60 is stored within the writing implement separately from the liquid-for-ink 50.

Furthermore, the way of storing the colorant 60 within the writing implement is not limited to the impregnation into the liquid-introducing core 40. For example, the colorant 60 prepared in solid form or in liquid form may be filled into the liquid-introducing channel 24 provided at a center of the collector 20. Moreover, the colorant 60 prepared in liquid form may be applied to an inner peripheral surface of the liquid-introducing channel 24 and then solidified, for example. Moreover, the colorant 60 prepared in liquid form may be applied to an outer peripheral surface of the liquid-introducing core 40 and then solidified, for example. Moreover, the colorant 60 prepared in solid form maybe embedded within the liquid-introducing core 40, for example. Further, the writing implement may be so fabricated that the colorant 60 prepared in liquid form is held in a certain portion other than the liquid-storing cell 30 and the colorant 60 is gradually added to the liquid-for-ink 50 according to flow of the liquid-for-ink 50.

Further, a description of direct dye, acid dye, basic dye, fluorescent dye, food color, oil-soluble dye, inorganic pigment, organic pigment, inorganic fluorescent pigment, organic fluorescent pigment, nonionic surfactant, anionic surfactant, and water-soluble polymers used for preparing the colorant 60 will be omitted because the description overlaps with that in the first embodiment.

(Liquid-Insoluble Substance 90)

A description of the liquid-insoluble substance 90 will be omitted because the description overlaps with that in the first embodiment.

(Third Embodiment)

An embodiment of a writing implement according to the present invention will be described below with reference to illustrations.

Figure 7:
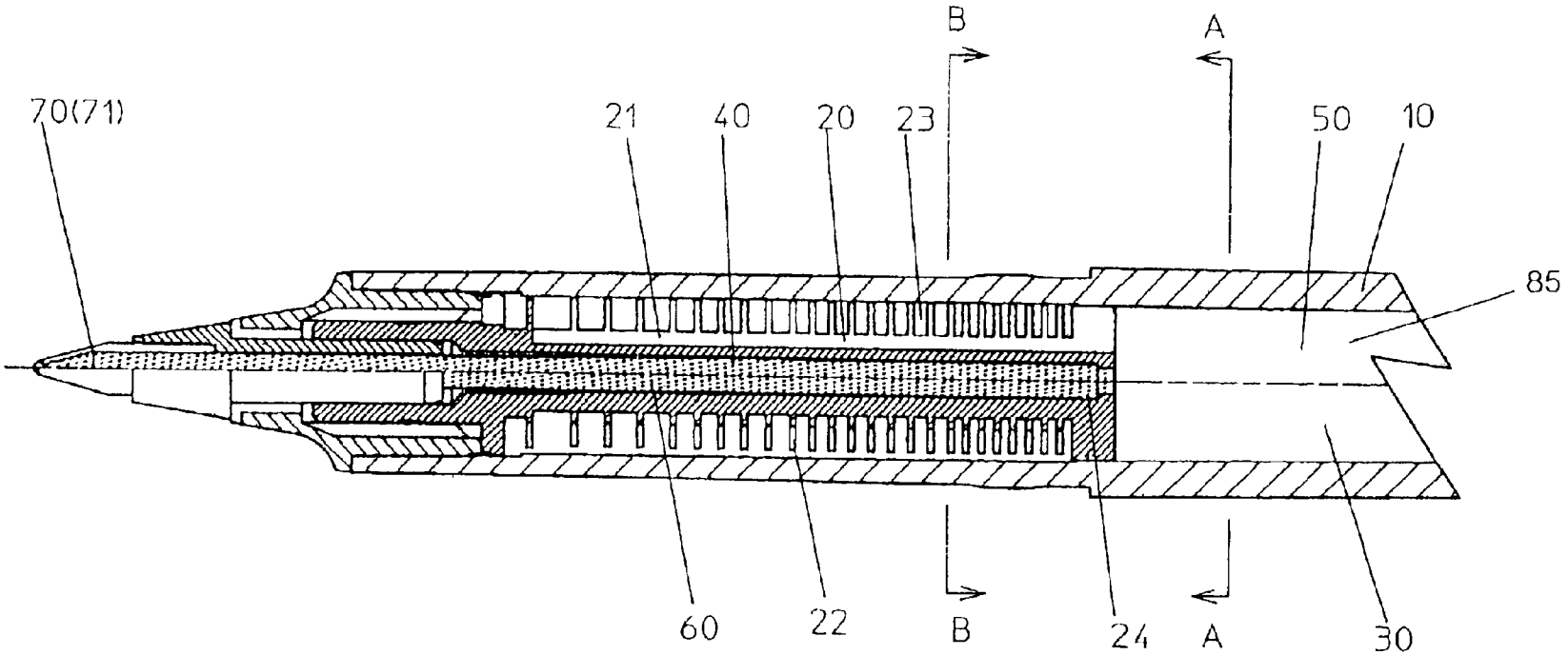
FIG. 7 is a side-sectional view of an essential part of a writing implement according to the third embodiment of the present invention.
Figure 8:
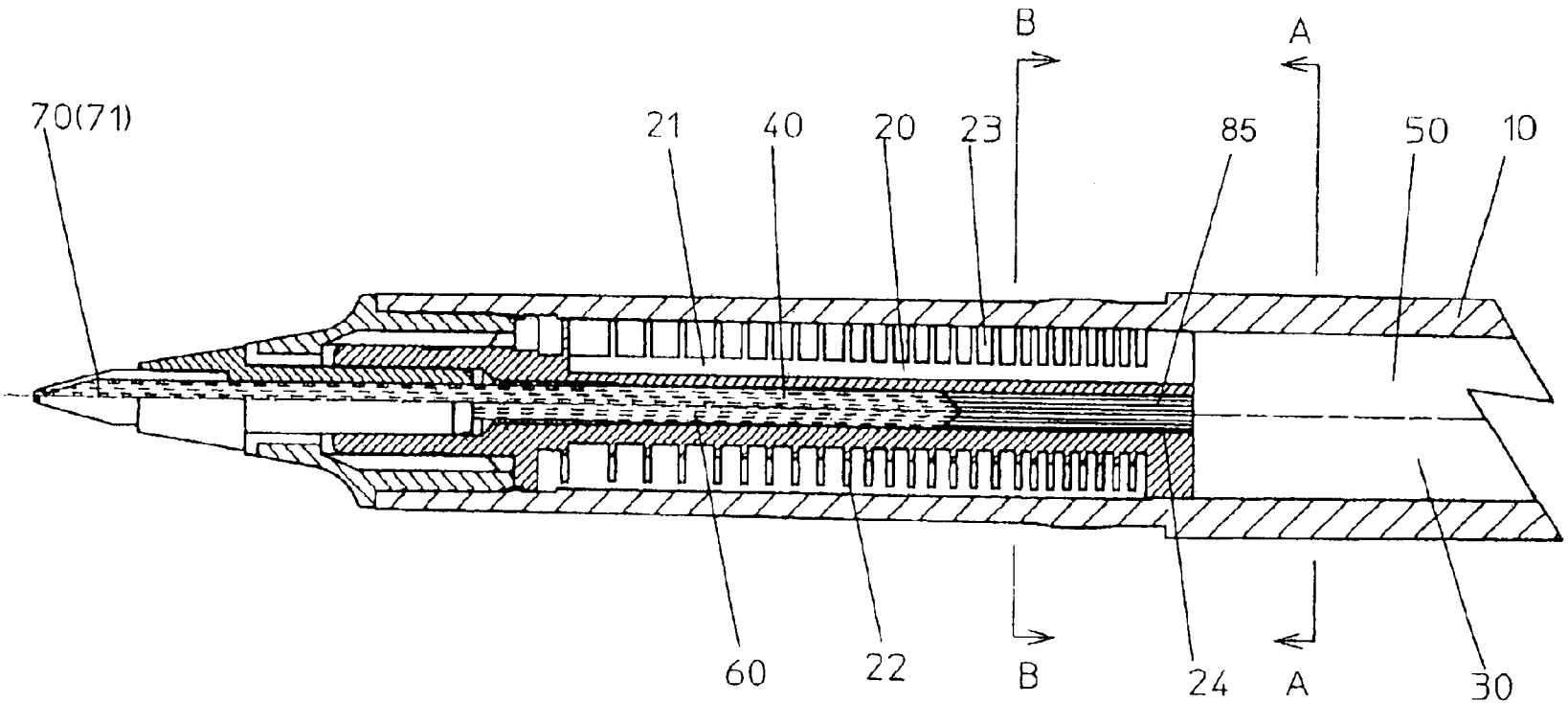
FIG. 8 is a side-sectional view of another essential part of the writing implement according to the fourth embodiment of the present invention.
Figure 9:
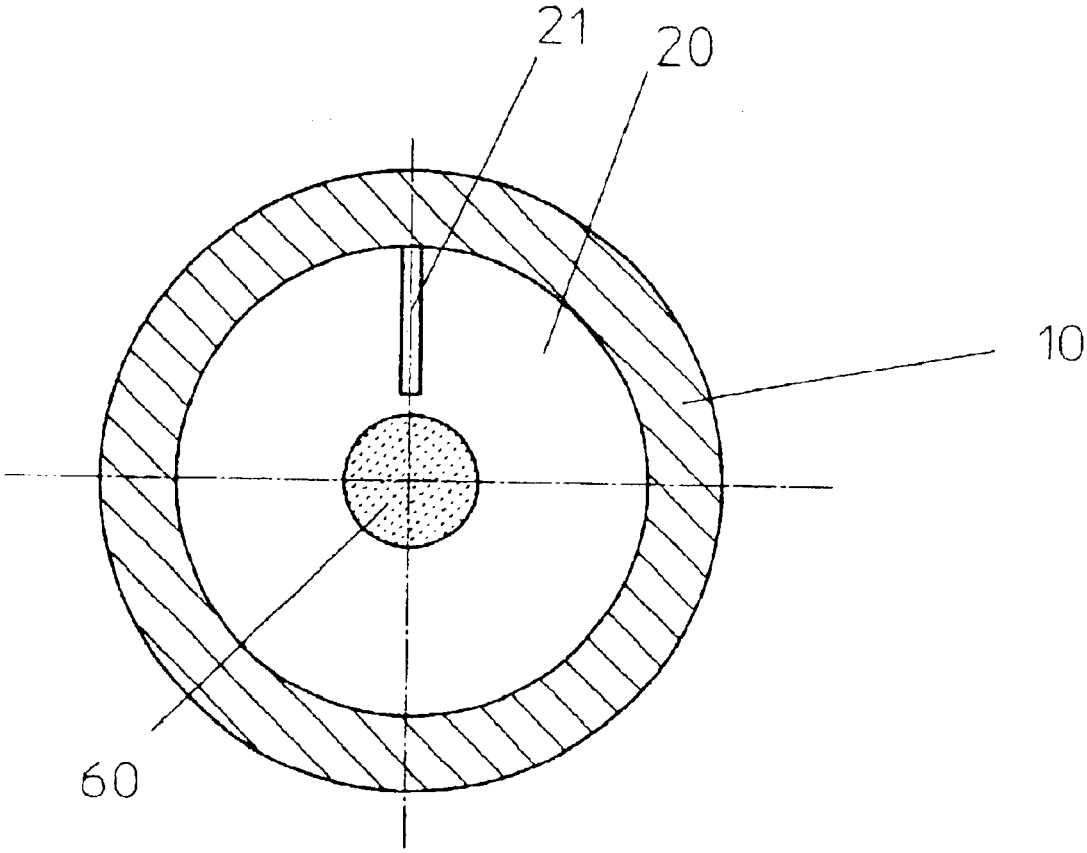
FIG. 9 is a sectional view taken along line A—A in FIG. 7.
Figure 10:
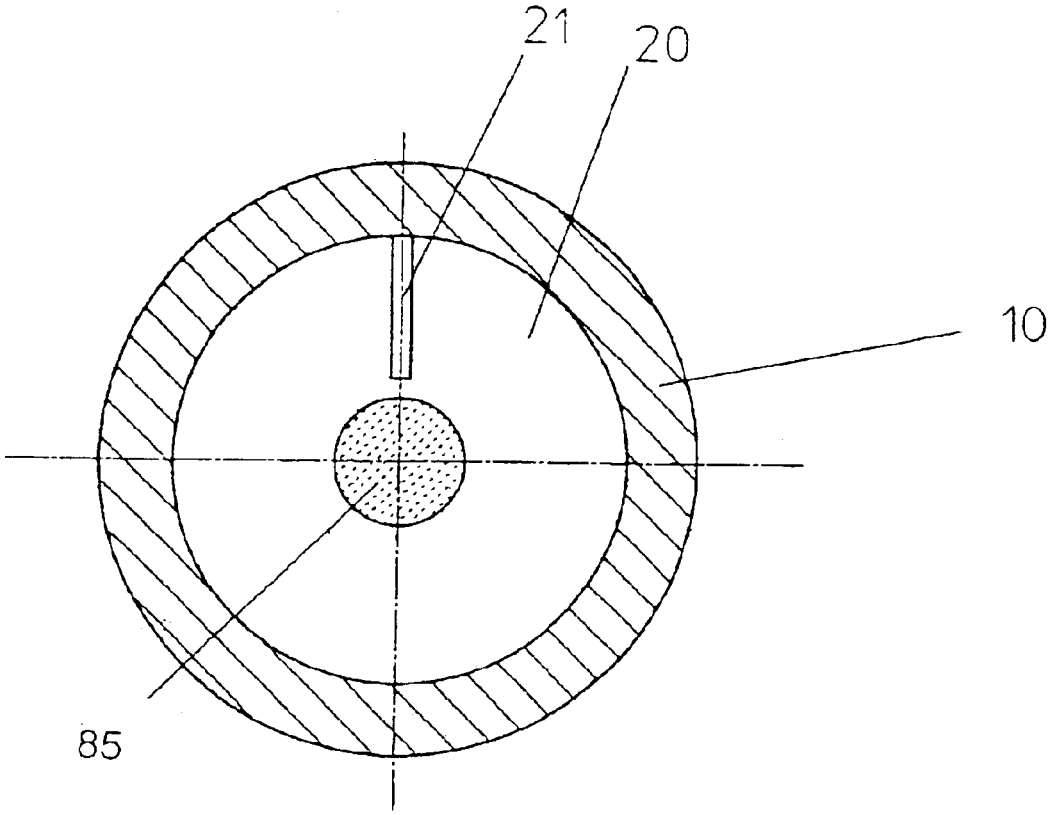
FIG. 10 is a sectional view taken along line A—A in FIG. 8.
Figure 11:
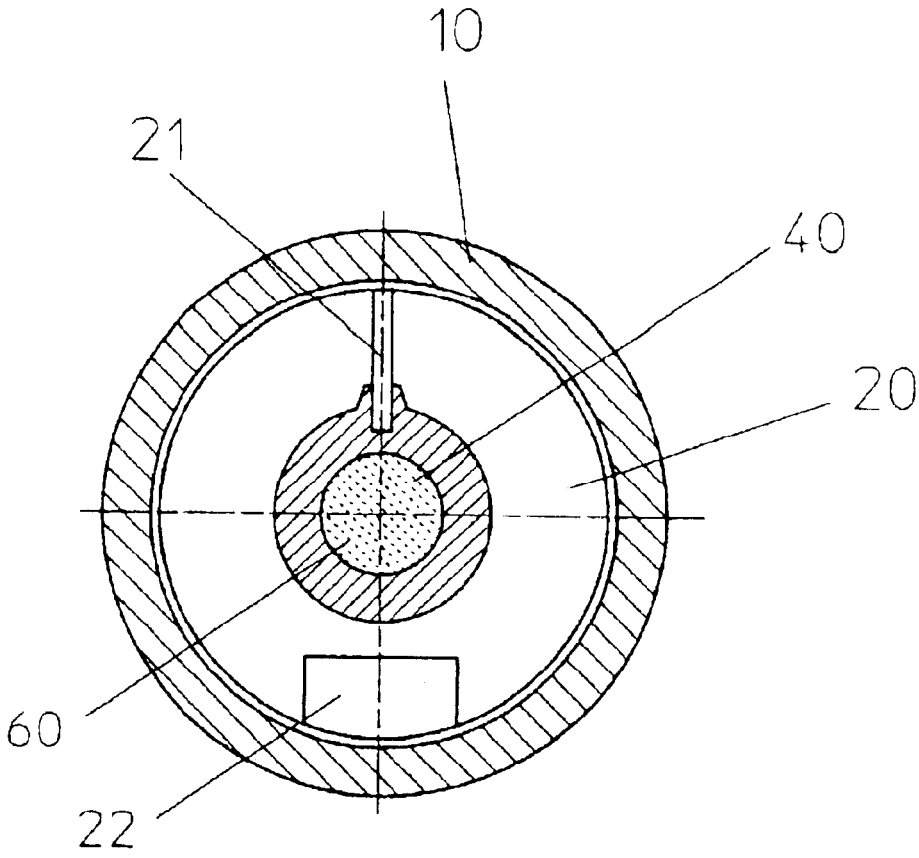
FIG. 11 is a sectional view taken along line B—B in FIG. 7.
Figure 12:
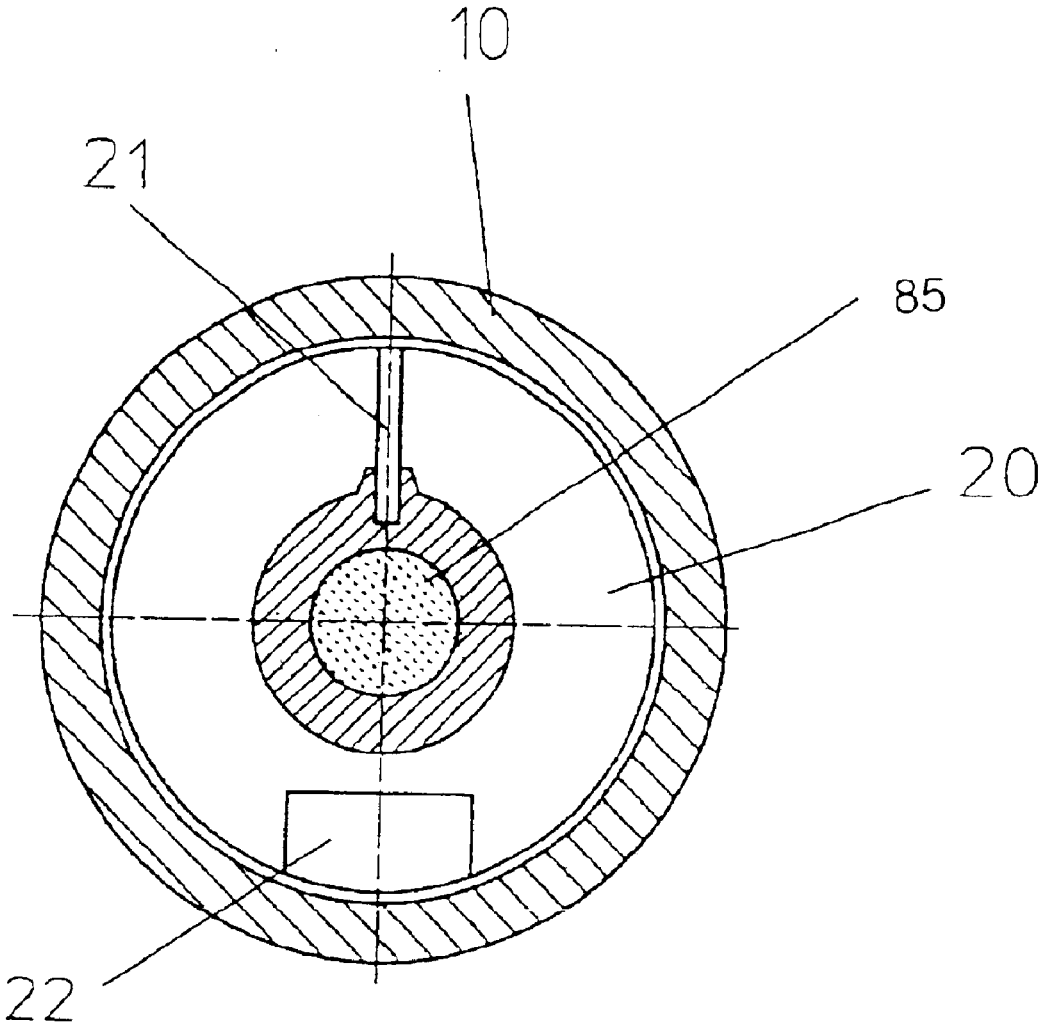
FIG. 12 is a sectional view taken along line B—B in FIG. 8.

Each of FIGS. 7 and 8 is a side-sectional view of an essential part of a writing implement according to the present embodiment.

As shown in FIGS. 7 and 8, the writing implement according to the present embodiment comprises a cylindrical shaft tube. A liquid-storing cell 30 for storing liquid-for-ink 50 is formed at an end inside the shaft tube. Moreover, a collector 20 for preventing and controlling the leakage of the liquid-for-ink from a pen tip, which is due to a pressure change within the liquid-storing cell 30, is inserted into another end inside the shaft tube.

Moreover, at an end of the collector 20 opposite to the liquid-storing cell 30, a ballpoint pen tip 71 is fixed as a writing tip 70.

Moreover, at a center of the collector 20 is provided a liquid-introducing channel 24 which penetrates therethrough from an end near to the liquid-storing cell 30 to another end near to the writing tip 70.

Moreover, into the liquid-introducing channel 24 is inserted a colored-liquid-introducing core 40 for introducing the liquid-for-ink 50 from the liquid-storing cell 30 to the writing tip 70.

The writing implement according to the present embodiment stores the liquid-for-ink 50 and the colorant 60 separately, by filling the liquid-storing cell 30 with the liquid-for-ink 50 as well as placing a surface-porous substance 85 within the liquid-storing cell 30 and further by impregnating the liquid-introducing core 40 with the colorant 60.

Moreover, the writing implement according to the present embodiment is so fabricated that the liquid-for-ink 50 penetrates to the writing tip 70 through the liquid-introducing core 40 which has been impregnated with the colorant 60, and consequently the colorant 60 is added to the liquid-for-ink 50 while the liquid-for-ink 50 is introduced to the writing tip 70.

Further, the writing implement according to the present embodiment will be described in detail as follows.

(Shaft Tube 10)

As shown in FIG. 7 and FIG. 8, the shaft tube 10 is approximately formed cylindrically, and a liquid-storing cell 30 for storing liquid-for-ink 50 is formed at an end inside the shaft tube 10. Moreover, a collector 20 for adjusting a pressure change within the liquid-storing cell 30 is inserted into another end inside the shaft tube 10.

Moreover, a description of the shaft tube 10 will be omitted because the description overlaps with that in the first embodiment.

(Collector 20)

The collector 20, shown in FIGS. 7 and 8, is used for adjusting a pressure change within the liquid-storing cell 30.

Moreover, a description of the collector 20 will be omitted because the description overlaps with that in the first embodiment.

(Liquid-Introducing Core 40)

The liquid-introducing core 40, shown in FIGS. 7 and 8, is used for introducing the liquid-for-ink 50 from the liquid-storing cell 30 to the writing tip 70.

Furthermore, a description of the liquid-introducing core 40 will be omitted because the description overlaps with that in the first embodiment.

(Writing Tip 70)

A description of the writing tip 70 will be omitted because the description overlaps with that in the first embodiment.

(Liquid-for-Ink 50)

A description of the liquid-for-ink 50 will be omitted because the description overlaps with that in the first embodiment.

(Colorant 60)

The colorant 60 corresponds to dye or pigment of the conventional ink, and is mainly composed of a component which is obtained by removing a vehicle from the conventional ink.

For example, the colorant 60 in solid form or in liquid form of high concentration can be prepared by using the dye or pigment of the conventional ink as it is.

Moreover, for example, the colorant 60 in liquid form of high concentration can be prepared by dissolving or dispersing an extremely large amount of dye or pigment in the vehicle of the conventional ink.

Specifically, the colorant 60 can be prepared by using, for example, dyes such as direct dye, acid dye, basic dye, fluorescent dye, a food color, etc., or alternatively, pigments such as inorganicpigment, organicpigment, inorganic fluorescent pigment, an organic fluorescent pigment, etc. as it is.

Moreover, the colorant 60 can also be prepared by dissolving or dispersing a large amount of dye or pigment described above in a blend which is obtained by appropriately mixing the water, the water-soluble organic solvent, the lubricant, the preservative, the anti-corrosive, the pH-controlling agent, the anti-drying agent, the thickener, the emulsion, etc. Further in this case, for the purpose of dispersing the pigment in the blend, it is preferable that nonionic surfactant, anionic surfactant, water-soluble polymers, etc. are blended as dispersant of the pigment.

Then, the liquid-introducing core 40 is impregnated with the colorant 60 prepared in liquid form. Thus, the colorant 60 is stored within the writing implement separately from the liquid-for-ink 50.

Furthermore, the way of storing the colorant 60 within the writing implement is not limited to the impregnation into the liquid-introducing core 40. For example, the colorant 60 prepared in solid form or in liquid form may be filled into the liquid-introducing channel 24 provided at a center of the collector 20. Moreover, the colorant 60 prepared in liquid form may be applied to an inner peripheral surface of the liquid-introducing channel 24 and then solidified, for example. Moreover, the colorant 60 prepared in liquid form may be applied to an outer peripheral surface of the liquid-introducing core 40 and then solidified, for example. Moreover, the colorant 60 prepared in solid form may be embedded within the liquid-introducing core 40, for example. Further, the writing implement may be so fabricated that the colorant 60 prepared in liquid form is held in a certain portion other than the liquid-storing cell 30 and the colorant 60 is gradually added to the liquid-for-ink 50 according to flow of the liquid-for-ink 50.

Further, a description of direct dye, acid dye, basic dye, fluorescent dye, food color, oil-soluble dye, inorganic pigment, organic pigment, inorganic fluorescent pigment, organic fluorescent pigment, nonionic surfactant, anionic surfactant, and water-soluble polymers used for preparing the colorant 60 will be omitted because the description overlaps with that in the first embodiment.

(Surface-Porous Substance 85)

Substance whose surface at least have porous structure may be placed within the liquid-storing cell 30 as shown in FIG. 7 or may be provided between a position where the colorant is contained and the liquid-storing cell 30 as shown in FIG. 8.

When the substance is placed within the liquid-storing cell 30 as shown in FIG. 7, the substance is used for adsorbing the colorant in order to prevent the colorant from diffusing into the liquid-for-ink 50. In this case, the substance can be directly placed within the liquid-for-ink 50 of the liquid-storing cell 30, or substance whose surface at least has a porous structure can be wrapped in other material to make a capsule, in order to place the substance within the liquid-storing cell 30, or the liquid-storing cell can be provided with a setting portion to which the substance whose surface at least has a porous structure is fixed.

Moreover, when the substance is set between the colorant-containing position and the liquid-storing cell 30 as shown in FIG. 8, the movement of the liquid-for-ink 50 toward the colorant 60 is not prevented, but a substance whose surface has a porous structure restricts and prevents the movement of the colorant toward the liquid-for-ink 50 by adsorbability of the substance.

As the substance whose surface at least has a porous structure, for example, a carbon-based material referred to as active carbon obtained by activating wood, coal, coconut shell, or synthetic resin such as saran or polyvinylidene chloride, fibrous active carbon obtained by activating polyacrylonitrile fibers, cellulose, or coal tar pitch, and other materials such as bone charcoal, zeolite, silica gel, alumina, or polymer materials can be used. The substance whose surface at least is porous has an ability to adsorb the colorant 60 because of its large surface area. Thereby, the substance has been widely used in such fields as decolorization and deodorization in petroleum refining or decolorization of a sugar liquid in sugar refining.

Furthermore, although a writing implement equipped with the collector 20 has been described in the present embodiment, the present invention is not limited to the writing implement equipped with the collector 20 and is also applicable to a direct ink type of ballpoint pen, fiber pen, or marker pen which are not equipped with collector 20, for example.

EXAMPLES

The first to third invention of the present invention will be further described in detail, based on examples shown in figures as follows.

Example 1

A writing implement having a following structure was manufactured.

First, liquid-for-ink 50 having a following composition was manufactured.

Water: 59.0% by weight.

Ethylene glycol (water-soluble organic solvent): 30.0% by weight.

Glycerin (water-soluble organic solvent): 10.0% by weight.

Potash soap H (surfactant): 1.0% by weight.

Moreover, colorant 60 having a following composition was manufactured.

Blue 105 (dye): 30.0% by weight.

Water: 18.45% by weight.

Ethyl alcohol (water-soluble organic solvent): 50.0% by weight.

Phenol (preservative): 0.5% by weight.

Ammonia water (pH-controlling agent): 0.5% by weight.

Benzotriazole (anti-corrosive): 0.05% by weight.

Potash soap H (surfactant): 0.5% by weight.

Then, the liquid-for-ink 50 was filled into the liquid-storing cell 30 of the writing implement shown in FIG. 1 in the embodiment, and the liquid-introducing core 40 of the writing implement shown in the embodiment was impregnated with the colorant 60 and dried.

Example 2

A writing implement having a following structure was manufactured.

First, liquid-for-ink 50 having a following composition was manufactured.

Spirone Red C-GH (dye): 0.1% by weight.

Water: 59.4% by weight.

N-methyl-2-pyrrolidone (water-soluble organic solvent): 30.0% by weight.

Glycerin (water-soluble organic solvent): 10.0% by weight.

Polyoxyethylene lauryl ether phosphate ester (surfactant): 0.5% by weight.

Moreover, colorant 60 having a following composition was manufactured.

Spirone Red C-GH (dye): 10.0% by weight.

Ethyl alcohol (water-soluble organic solvent): 40.0% by weight.

N-methyl-2-pyrrolidone (water-soluble organic solvent): 48.45% by weight.

Phenol (preservative): 0.5% by weight.

Ammonia water (pH-controlling agent): 0.5% by weight.

Benzotriazole (anti-corrosive): 0.05% by weight.

Polyoxyethylene lauryl ether phosphate ester (surfactant): 0.5% by weight.

Then, the liquid-for-ink 50 was filled into the liquid-storing cell 30 of the writing implement shown in FIG. 1 in the embodiment, and the liquid-introducing core 40 of the writing implement shown in the embodiment was impregnated with the colorant 60 and dried.

Example 3

A writing implement having a following structure was manufactured.

First, liquid-for-ink 50 having a following composition was manufactured.

Water: 64.8% by weight.

Glycerin (water-soluble organic solvent): 25.0% by weight.

Propylene glycol (water-soluble organic solvent): 10.0% by weight.

Potassium linoleate (surfactant): 0.2% by weight.

Moreover, colorant 60 having a following composition was manufactured.

Carbon Black (pigment): 30.0% by weight.

Water: 39.05% by weight.

Glycerin (water-soluble organic solvent): 10.0% by weight.

Propylene glycol (water-soluble organic solvent): 10.0% by weight.

Styrene-maleic acid resin (dispersant): 10.0% by weight.

Phenol (preservative): 0.3% by weight.

Benzotriazole (anti-corrosive): 0.05% by weight.

Ammonia water (pH-controlling agent): 0.3% by weight.

Potassium linoleate (surfactant): 0.3% by weight.

Then, the liquid-for-ink 50 was filled into the liquid-storing cell 30 of the writing implement shown in the embodiment, and the liquid-introducing core 40 of the writing implement shown in the embodiment was impregnated with the colorant 60 and dried.

(Evaluation of Writing Implement)

Each writing implement of the Examples 1 to 3 was evaluated.

Each writing implement of the Examples 1 to 3 was able to store the liquid-for-ink 50 and the colorant 60 stored separately.

Moreover, each writing implement of the Examples 1 to 3 was able to make the colorant 60 difficult to mix into the liquid-for-ink 50 by a colorant-moving-direction-restricting member 80.

Further, each writing implement of the Examples 1 to 3 was able to write with ink showing a predetermined color (blue, red, or black) at the writing tip 70.

Thus, each writing implement of the Examples 1 to 3 was able to show an appearance completely different from that of the conventional one.

The fourth to eighth invention of the present invention will be further described in detail, based on examples as follows.

Example 4

A writing implement having a following structure was manufactured.

First, liquid-for-ink 50 having a following composition was manufactured.

Purified water: 57.45% by weight.

N-methyl-2-pyrrolidone (water-soluble organic solvent): 30% by weight.

Glycerin (water-soluble organic solvent): 10% by weight.

Polyoxyethylene lauryl ether phosphate ester (surfactant): 0.5% by weight.

Triethanolamine (pH-controlling agent): 1.0% by weight.

Benzotriazole (anti-corrosive): 0.05% by weight.

Moreover, colorant having a following composition was manufactured.

Spirone Red C-GH (dye, Hodogaya Chemical, Co. Ltd.): 10% by weight.

Ethyl alcohol: 90% by weight.

Then, the liquid-for-ink 50 was filled into the liquid-storing cell 30 of the writing implement shown in the embodiment, and the liquid-introducing core 40 of the writing implement shown in FIG. 4 in the embodiment was impregnated with the colorant 60 and dried.

Moreover, the captured-liquid-introducing core 41 was joined to the colored-liquid-introducing core 40 between the colored-liquid-introducing core 40 and the liquid-storing cell 30. As the liquid-introducing core, the following materials were used.

Colored-liquid-introducing core: polyester fiber bundle core (outer-coated with resin), porosity 60%.

Captured-liquid-introducing core: polyester fiber bundle core (outer-coated with resin), porosity 35%.

Comparative Example 1

A writing implement was manufactured as described in the Example 4, except that the captured-liquid-introducing core 41 was eliminated and that the colored-liquid-introducing core 40 was directly in contact with the liquid-storing cell 30.

Example 5

A writing implement having a following structure was manufactured.

First, liquid-for-ink 50 having a following composition was manufactured.

Spirone Yellow C-GNH (dye, Hodogaya Chemical, Co. Ltd.): 0.01% by weight.

Purified water: 54.04% by weight.

2-pyrrolidone: 30% by weight.

Glycerin: 10% by weight.

Styrene-acrylic resin J-61J (thickener, Johnson Polymer Co.): 5% by weight.

Potash soap H (surfactant): 0.3% by weight.

Phenol (preservative): 0.1% by weight.

Ammonia water (pH-controlling agent): 0.5% by weight.

Benzotriazole (anti-corrosive): 0.05% by weight.

Moreover, colorant 60 having a following composition was manufactured.

Spirone Yellow C-GNH (dye, Hodogaya Chemical, Co. Ltd.): 10% by weight.

Ethyl alcohol: 90% by weight.

Then, the liquid-for-ink was filled into the liquid-storing cell 30 of the writing implement shown in FIG. 4 in the embodiment, and the colored-liquid-introducing core 40 of the writing implement shown in FIG. 4 in the embodiment was impregnated with the colorant 60 and dried.

Moreover, the captured-liquid-introducing core 41 was joined to the colored-liquid-introducing core 40 between the colored-liquid-introducing core 40 and the liquid-storing cell 30. As the liquid-introducing core, the following materials were used.

Colored-liquid-introducing core: polyester fiber bundle core (outer-coated with resin), porosity 60%.

Captured-liquid-introducing core: acrylonitrile-butadiene rubber products (porous body), porosity 50%.

Comparative Example 2

A writing implement was manufactured as described in the above example 5, except that the captured-liquid-introducing core 41 was eliminated and that the colored-liquid-introducing core 40 was directly in contact with the liquid-storing cell 30.

Each writing implement of the Examples 4 and 5 and Comparative Examples 1 and 2 was able to store the liquid-for-ink 50 and the colorant 60 separately.

Further, each writing implement of the Examples 4 and 5 and Comparative Examples 1 and 2 was able to write with ink showing a predetermined color (red, yellow) at the writing tip 70.

Moreover, each writing implements was left horizontally for a month at room temperature. Then, conditions and writing performance of the liquid-for-ink 50 were compared. The result of the comparison is summarized in Table 1 described below.

TABLE 1

Temporal Changes in Liquid-for-Ink and in Writing Performance

| Evaluated Writing Implement | Appearance of Liquid-for-Ink Immediately after the Fabrication | Appearance of Liquid-for-Ink after a Month | Writing Performance |
|---|---|---|---|
| Example 4 | Colorlessly-Transparent | Colorlessly-Transparent | Good |
| Example 5 | Colored in Light Yellow | Colored in Light Yellow | Good |
| Comparative Example 1 | Colorlessly-Transparent | Colored in Red | Good |
| Comparative Example 2 | Colored in Light Yellow | Colored in Yellow | Good |

The ninth to eleventh invention of the present invention will be further described in detail, based on examples as follows.

Example 6

A writing implement having a following structure was manufactured.

First, liquid-for-ink 50 having a following composition was manufactured.

Purified water: 57.45% by weight.

N-methyl-2-pyrrolidone (water-soluble organic solvent): 30% by weight.

Glycerin (water-soluble organic solvent): 10% by weight.

Polyoxyethylene laurylether phosphate ester (surfactant): 0.5% by weight.

Triethanolamine (pH-controlling agent): 1.0% by weight.

Benzotriazole (anti-corrosive): 0.05% by weight.

Moreover, colorant having a following composition was manufactured.

Spirone Red C-GH (dye, Hodogaya Chemical, Co., Ltd.): 10% by weight.

Then, the liquid-for-ink 50 was filled into the liquid-storing cell of the writing implement in the embodiment, and the liquid-introducing core 40 of the writing implement shown in FIG. 7 in the embodiment was impregnated with the colorant 60 and dried.

Moreover, as substances whose surfaces at least were porous, granular activated carbons as described below were placed in the liquid-storing cell of the writing implement so that a volume of the activated carbons become 10% of that of the liquid-storing cell.

Activated carbon (granular activated carbon, Taikoh SG, Futamura Chemical Industries Co., Ltd.,): 10%.

Comparative Example 3

A writing implement was manufactured as described in the Example 6, except that the activated carbons were eliminated.

Example 7

A writing implement having a following structure was manufactured.

First, liquid-for-ink 50 having a following composition was manufactured.

Spirone Yellow C-GNH (dye, Hodogaya Chemical, Co., Ltd.): 0.01% by weight.

Purified water: 54.04% by weight.

2-pyrrolidone: 30% by weight.

Glycerin: 10% by weight.

Styrene-acrylic resin J-61J (thickener, Johnson Polymer Co.): 5% by weight.

Potash soap H (surfactant): 0.3% by weight.

Phenol (preservative): 0.1% by weight.

Ammonia water (pH-controlling agent): 0.5% by weight.

Benzotriazole (anti-corrosive): 0.05% by weight.

Moreover, colorant 60 having a following composition was manufactured.

Spirone Yellow C-GNH (dye, Hodogaya Chemical, Co., Ltd.) 10% by weight.

Ethyl alcohol: 90% by weight.

Then, the liquid-for-ink was filled into the liquid-storing cell 30 of the writing implement shown in FIG. 2 in the embodiment, and the liquid-introducing core 40 of the writing implement shown in FIG. 7 in the embodiment was impregnated with the colorant and dried.

Moreover, fibrous activated carbons as described below were loaded between the liquid-introducing core 40 containing the dye, and the liquid-storing cell 30.

Fibrous activated carbon (ACF, Futamura Chemical Industries Co., Ltd.): products.

Comparative Example 4

A writing implement was manufactured as described in the Example 5, except that the fibrous activated carbons were eliminated and that fibrous bundle core was loaded instead.

Example 8

First, liquid-for-ink 50 having a following composition was manufactured.

Purified water: 79.42% by weight.

Propylene glycol: 10% by weight.

Glycerin: 10% by weight.

Benzotriazole (anti-corrosive): 0.05% by weight.

Triethanolamine (pH-controlling agent): 0.5% by weight.

1,2-benzoisothiazoline-3-one (preservative): 0.03% by weight.

Moreover, colorant 60 as described below was manufactured.

Carbon Black dispersion liquid (CW-1, Orient Co.): 50% by weight.

Purified water: 50% by weight.

Then, the liquid-for-ink was filled into the liquid-storing cell 30 of the writing implement shown in FIG. 1 in the embodiment, and the liquid-introducing core 40 of the writing implement shown in FIG. 7 in the embodiment was impregnated with the colorant and dried.

Moreover, as substances whose surfaces at least were porous, synthetic adsorbent materials as described below were placed in the liquid-storing cell of the writing implement so that a volume of the synthetic adsorbent materials become 10% of that of the liquid-storing cell.

DIAION-HP20 (Mitsubishi Chemical Corporation): 10%.

Comparative Example 5

A writing implement was manufactured as described in the Example 6, except that the synthetic adsorbent materials were eliminated.

Each writing implement of the Examples 4 to 6 and Comparative Examples 1 to 3 was able to store the liquid-for-ink 50 and the colorant 60 separately.

Further, each writing implement of the Examples 1 to 3 and Comparative Examples 1 to 3 was able to write with ink showing a predetermined color (red, yellow, or black) at the writing tip 70.

Moreover, each writing implements was left horizontally for three months at room temperature. Then, conditions and writing performance of the liquid-for-ink 50 were compared. The result of the comparison is summarized in Table 2 described below.

TABLE 2

Temporal Changes in Liquid-for-Ink and in Writing Performance

| Evaluated Writing Implement | Appearance of Liquid-for-Ink Immediately after the Fabrication | Appearance of Liquid-for-Ink after Three Months | Writing Performance |
|---|---|---|---|
| Example 6 | Colorlessly-Transparent | Colorlessly-Transparent | Good |
| Example 7 | Colored in Light Yellow | Colored in Light Yellow | Good |
| Example 8 | Colorlessly-Transparent | Colorlessly-Transparent | Good |
| Comparative Example 3 | Colorlessly-Transparent | Colored in Red | Good |
| Comparative Example 4 | Colored in Light Yellow | Colored in Yellow | Good |
| Comparative Example 5 | Colorlessly-Transparent | Colored in Black | Good |

INDUSTRIAL APPLICABILITY

The present invention may be applied to a writing implement, such as a fountain pen, a ballpoint pen, a felt pen, a marking pen, a needle pen, etc.

What is claimed is:

1. A writing implement, wherein liquid-for-ink and a main part of colorant for coloring the liquid-for-ink are separately stored;

wherein the colorant is added to the liquid-for-ink while the liquid-for-ink is introduced to a writing tip; and wherein a colorant-moving-direction-restricting member which restricts the movement of the colorant toward the liquid-for-ink is provided between the liquid-for-ink and the colorant.

2. The writing implement according to claim 1, wherein liquid-insoluble substance is included in the liquid-for-ink.

3. A writing implement, wherein liquid-for-ink and a main part of colorant for coloring the liquid-for-ink are stored separately;

wherein the colorant is added to the liquid-for-ink while the liquid-for-ink is introduced to a writing tip;

wherein, as a colorant-moving-direction-restricting member, a material with a capillary activity is incorporated between a liquid-for-ink-storing portion and a colorant-storing portion;

wherein the colorant-storing portion is wade by a colored-liquid-introducing core which is impregnated with the colorant; and wherein the material with a capillary activity is made by a captured-liquid-introducing core which introduces the liquid-for-ink to the colorant-storing portion and captures the colorant while the colorant moves toward the liquid-for-ink.

4. The writing implement according to claim 3, wherein the material with a capillary activity is directly provided between the liquid-for-ink-storing portion and the colorant-storing portion.

5. The writing implement according to claim 3, wherein the material with a capillary activity is divided and provided between the liquid-for-ink-storing portion and the colorant-storing portion.

6. The writing implement according to claim 3, wherein the material with a capillary activity consists of a combination of a plurality of materials with different capillary activities.

7. A writing implement;

wherein liquid-for-ink and a main part of colorant for coloring the liquid-for-ink are stored separately;

wherein the colorant is added to the liquid-for-ink while the liquid-for-ink is introduced to a writing tip;

wherein, as a colorant-moving-direction-restricting member, a material with a capillary activity is incorporated between a liquid-for-ink-storing portion and a colorant-storing portion;

wherein the colorant-storing portion is made by a colored-liquid-introducing core which is impregnated with the colorant; and wherein the material with a capillary activity is divided and provided between the liquid-for-ink-storing portion and the colorant-storing portion.

8. The writing implement according to claim 7, wherein the material with a capillary activity consists of a combination of a plurality of materials with different capillary activities.

9. A writing implement;

wherein liquid-for-ink and a main part of colorant for coloring the liquid-for-ink are stored separately, wherein the colorant is added to the liquid-for-ink while the liquid-for-ink is introduced to a writing tip;

wherein a substance whose surface is porous, as a colorant-moving-direction-restricting member, is incorporated between the liquid-for-ink and the colorant;

wherein an introducing core for the liquid-for-ink in positioned between the liquid-for-ink and the colorant; and wherein the colorant-moving-direction-restricting member is positioned either between the liquid-for-ink and the introducing core, or between the introducing core and the colorant.

10. A writing implement;

wherein liquid-for-ink and a main part of colorant for coloring the liquid-for-ink are stored separately;

wherein the colorant is added to the liquid-for-ink while the liquid-for-ink is introduced to a writing tip; and wherein a substance whose surface is porous is incorporated in the liquid-for-ink as a colorant-moving-direction-restricting member.

11. A writing implement;

wherein liquid-for-ink and a main part of colorant for coloring the liquid-for-ink are stored separately;

wherein the colorant is added to the liquid-for-ink while the liquid-for-ink is introduced to a writing tip; and wherein at least one material selected from the group consisting of active carbon, zeolite, silica gel, alumina, and ion-exchanging resin is incorporated in the liquid-for-ink as a colorant-moving-direction-restricting member and/or at least one material selected from the group consisting of active carbon, zeolite, silica gel, alumina, and ion-exchanging resin is positioned between the liquid-for-ink and the colorant as a colorant-moving-direction-restricting member.

12. The writing implement according to claim 11, wherein said at least one material selected from the group consisting of active carbon, zeolite, silica gel, alumina, and ion-exchanging resin is directly positioned between the liquid-for-ink and the colorant.

13. The writing implement according to claim 11;

wherein an introducing core for the liquid-for-ink is positioned between the liquid-for-ink and the colorant; and wherein said at least one material selected from the group consisting of active carbon, zeolite, silica gel, alumina, and ion-exchanging resin is positioned either between the liquid-for-ink and the introducing core, or between the introducing core and the colorant.

14. A writing implement;

wherein liquid-for-ink and a main part of colorant for coloring the liquid-for-ink are stored separately;

wherein the colorant is added to the liquid-for-ink while the liquid-for-ink is introduced to a writing tip; and wherein a collector is inserted between a liquid-storing cell storing the liquid-for-ink and the writing tip, which prevents and regulates the leakage of the liquid-for-ink from the writing tip due to the pressure change within the liquid-storing cell.

* * * * *